United States Patent [19]

Wiebe

[11] Patent Number: 4,915,031

[45] Date of Patent: Apr. 10, 1990

[54] RAILWAY TRUCK DAMPING ASSEMBLY

[75] Inventor: Donald Wiebe, Sewickley, Pa.

[73] Assignee: Hansen, Inc., Pittsburgh, Pa.

[21] Appl. No.: 291,428

[22] Filed: Dec. 23, 1988

Related U.S. Application Data

[63] Continuation-in-part of Ser. No. 741,299, Jun. 4, 1985, abandoned, which is a continuation-in-part of Ser. No. 467,565, Feb. 17, 1983, abandoned, which is a continuation-in-part of Ser. No. 278,755, Jun. 29, 1981, abandoned.

[51] Int. Cl.[4] ..... B61F 5/12

[52] U.S. Cl. ..... 105/198.2; 267/211

[58] Field of Search ..... 105/193, 197.1, 197.05, 105/198.2, 198.5, 198.4, 33, 152, 9; 267/211

[56] References Cited

U.S. PATENT DOCUMENTS

| | | | |
|---|---|---|---|
| 2,053,990 | 9/1936 | Goodwin | 105/193 |
| 2,257,109 | 9/1941 | Davidson | 267/211 X |
| 2,277,263 | 3/1942 | Tucker | 105/197 DB |
| 2,333,921 | 11/1943 | Flesch | 105/197 DB |
| 2,485,970 | 10/1949 | Lehrman | 105/197 DB |
| 2,578,480 | 12/1951 | Lehrman | 105/197 DB |
| 3,799,067 | 3/1974 | Neuman et al. | 267/211 X |
| 4,103,623 | 8/1978 | Radwill | 267/211 X |
| 4,167,907 | 9/1979 | Mullahy et al. | 105/197 DB |
| 4,230,047 | 10/1980 | Wiebe | 105/197 DB |
| 4,256,041 | 3/1981 | Kemper et al. | 267/211 X |
| 4,295,429 | 10/1981 | Wiebe | 105/197 DB |

FOREIGN PATENT DOCUMENTS 1178123 11/1984 Canada .

*Primary Examiner*—Andres Kashnikow

[57] ABSTRACT

A railway truck assembly provides sprung support of a car body with respect to the truck wheels by means of compression springs interposed between axle carried supports such as truck side frames and a car body support such as a bolster, wherein biased friction assemblies provide fit-up and friction damping of relative motion between the axle carried supports and the car body support, the friction assemblies including rigid metallic friction members and elastomeric elements received in a pocket formed by spaced surfaces which engage the respective members with the elastomeric elements in biased engagement with a pocket surface and having an elastic characteristic to provide an elastomeric response for non-rigid compliance and cushioning of low level car body support force variation through elastic deformation thereof, and damping of larger level car body support force variation through bodily sliding of the friction wedges on frictionally engaged surfaces in repeatable cycles of elastomeric cushioning, friction break, and bodily sliding.

49 Claims, 9 Drawing Sheets

RAILWAY TRUCK DAMPING ASSEMBLY

BACKGROUND OF THE INVENTION

This application is a continuation-in-part of application Ser. No. 741,299, filed June 4, 1985, which is a continuation-in-part of application Ser. No. 467,565, filed Feb. 17, 1983, which is a continuation-in-part of application Ser. No. 278,755, filed June 29, 1981, all now abandoned.

In the railway industry it has been common practice to support the opposite ends of a freight car body on spaced-apart, wheeled truck assemblies for traverse of standard gauge railway track. The standard wheeled truck assembly is generally referred to as a three-piece truck because its principal structural members are a pair of spaced side frames which extend generally longitudinally of the opposite sides of the freight car body, respectively, and an elongated bolster which extends transversely of the freight car body. The side frames of each such truck are supported on plural wheel and axle sets, commonly two sets, which are spaced apart along the track. The longitudinal ends of the bolster are received in openings in the opposed side frames, respectively, and are supported therein by a suspension system including respective spring sets to permit movement of the bolster relative to each of the opposed side frames. In various configurations of spring sets the springs extend between a spring seat on the side frame and a respective undersurface of the bolster spaced above the spring seat. The freight car body is supported adjacent its longitudinal ends by respective central portions of the bolsters in the respective spaced truck assemblies.

Such support of a freight car body permits the freight car body to rock laterally with respect to the longitudinal axis of the bolsters, that is, transversely of the track as the freight car travels over normal track. Normal track is frequently non-uniform due to such causes as differential track settlement resulting from non-uniform ballast or foundation under the railway ties, excess rail wear, and/or rail misalignment. Thus, under normal operating conditions the wheel movements in the truck assemblies may be such that energy imparted to the truck suspension system will cause the car body to bounce or sway. With the commonly used spring suspension system a car body has a natural resonant frequency of sway and bounce and, if the track surface and alignment are such as to cause the car body to sway or bounce at its resonant frequency, the truck wheels can become unloaded; that is, the forces between the wheels and rail can be significantly reduced and in the extreme can become nil and the wheels are lifted from the rail. Frequently, as a freight car body sways, the wheels on opposite sides of the car body may be alternately unloaded. Any wheel unloading substantially increases the risk of derailment.

The most common expedient presently being employed to dissipate the energy imparted to the suspension system of a truck assembly is a friction assembly utilizing a rigid metal friction wedge or friction shoe to damp relative motion between the bolster and the side frames. The use of rigid friction shoes or wedges is so common that practically all the freight cars built in the past 40 years have bolsters with opposed pockets formed in the longitudinal ends thereof for receiving friction shoes. U.S. Pat. No. 3,461,815 illustrates a more recent design of a friction assembly with shoe members received within bolster pockets. The respective side frames are provided with replaceable wear plates outwardly adjacent the open ends of the bolster pockets so that opposed friction shoes at each end of the bolster engage the opposed rigid side frame wear surfaces. Such friction wedges and wear plates, which are normally cast steel members, tend to "stick" or resist sliding movement until the force applied to the friction wedge reaches a magnitude which is sufficient to overcome the static friction force existing between the engaged surfaces of the wedge and the wear surface. Once such static friction force is overcome, the friction wedges suddenly breakaway and slide with respect to the respective adjacent wear surfaces. This "stick-slip" frictional action provides dynamic friction damping of the relative movement between the bolster and side frame; however, such a damping system has adverse consequences due to the abrupt nature of the "stick-slip" action. For example, in an empty car the force required to cause sliding of a wedge or the break away friction force of the combined suspension groups can approach the weight of the empty car body so that the benefit of the respective spring group is effectively nullified and the car body is in effect directly coupled to the side frames and wheel sets. When such effective coupling occurs, the force inputs to the bolsters and side frames can cause structural fatigue problems. The "stick-slip" effect occurs prior to overcoming the friction between the engaged friction surfaces, regardless of the direction of the impending motion between a bolster and side frame. That is, vertical or lateral forces, or a combination thereof can be imposed between the bolster and side frames as a freight car travels over typical railway track.

Rigid friction wedges must fit up in the bolster pockets and for such purpose the inner inclined surfaces of the bolster pocket is provided with an outwardly spherically convex or crowned surface to provide a centering force reaction between the bolster surface and the back or sloped surface or face of the friction wedge. This more or less centered reaction between the bolster pocket and wedge is necessary to provide a uniform pressure between the opposed wedge face and the column wear plate as the bolster rotates about either its vertical or longitudinal axis relative to the side frame. If the contact interface, that is the reaction resultant between the sloping inner surface of the bolster and the surface of the wedge, is over to one side of the bolster pocket or near the top or bottom of the sloped surface of the bolster pocket, the friction generating pressure between the wedge surface and the column wear plate will vary accordingly to the location of the contact interface. The "as cast" surfaces of the bolster pockets and the wedges are sufficiently imprecise when assembled new, even when within specified tolerances, to cause serious friction damping variations and even bolster-side frame lock up. Additionally, the softer nonheat treated pocket surfaces wear sufficiently in a short period of service to permit the crown of the wedge to literally wear into the bolster surface causing bolster pocket reactions to transfer readily to the wedge. Such "camming" behavior between the wedge, bolster pocket and column wear plate causes accelerated wear and high strains resulting in potential early failure and replacement or repair of each or all of these aforementioned related truck components.

Another type of friction wedge utilizes spaced winged surfaces. Rigid, constant, load, friction, winged shoe wedges similar to the embodiment showing sloped portions or surfaces on either side of a central spring retaining cavity, also require crowned surfaces on the slopes to insure that the reactions from the bolster slope interaction occur near the center of the sloped surface area. The degenerative wear implications follow the same pattern as the earlier discussed variable load rigid friction wedges.

The inventor in this application has previously developed elastomeric materials for use as friction elements as shown and described in U.S. Pat. No. 4,230,047, now Reissue Patent No. 31,784, and U.S. Pat. No. 4,295,429, which are incorporated herein in their entirety by reference for a better understanding of the present invention. The elastomeric friction elements disclosed in the identified patents offer improved damping for all modes of relative bolster to side frame motion; however, the use of friction elements made entirely of an elastomeric materials may not provide the most desirable modes of operation. Specifically, the elastomeric elements as decribed in the identified patents are confined by the surfaces of the column wear plate, bolster and spring biased follower such that the elastomeric elements are simultaneously placed in normal compression and shear with respect to all the confining surfaces. As the bolster moves in various modes, such elastomeric elements will deform and move, that is, slide partially relative to all of their confining surfaces, and with sufficient movement of the bolster with respect to the side frames, the elastomeric element will slide bodily in its deformed condition with respect to the column wear surface. Under operating conditions, non-uniform pressures will occur on the various confined surfaces of the elastomeric elements that will cause the elastomeric elements to deform, bunch up, or compress in the areas of highest pressure, especially along the column wear surface where the elastomeric elements are required to slide appreciable distances. Such deformation can overstrain portions of an elastomeric element thus causing those portions to take a permanent set and/or lose some of their resiliency or fail structurally. When the resiliency of an elastomeric element loses uniformity, its ability to operate as described in the identified patents may be substantially impaired. In addition, under repeated high force levels applied to an elastomeric element, the elastomer may well become overheated which also effects the elasticity of the element. Under extreme operating temperature the elastomer can experience a modulus of elasticity or stiffness reduction of such magnitude that relative motion between the bolster and side frame results primarily in deformation of the elastomeric element with minimal sliding and without generating any substantial frictional restraint at the column guide wear surfaces. Under these conditions, the elastomeric friction element will not operate as described in the identified patents. When excessive deformation of the elastomeric element occurs without sliding at the column wear plate, there is insufficient friction generated by the elastomeric element to provide the desired damping of the bolster motion. Also, overstraining and overheating thereof can cause deterioration of an elastomeric friction element.

Mechanical factors also can adversely affect the friction force produced by an elastomeric element as shown in the identified patents. For example, the friction generating metal surfaces, that is, the wear surfaces on the columns which mate with the elastomeric member, are generally not machined or precision surfaces. The steel wear plates are usually bolted or welded to the side frames and, as a result, the edges of countersunk fastener receiving holes, fastener heads and/or weld fillets may well be encountered by the surface of the elastomeric element as it moves on the wear plate surfaces. Any of these conditions can cause excessively high friction and localized shear forces which may result in gouging or accelerated wear on the elastomeric friction generating surface.

In addition to rigid or elastomeric friction elements, hydraulic snubbers have been used to dissipate the energy input to a railway truck assembly; however, such snubbers do not rely upon friction to dissipate energy. Such snubbers are mentioned herein only to emphasize that control of the force inputs to a truck assembly requires the conversion of a sufficient amount of the input energy into heat energy and thereafter dissipation of the heat energy to the atmosphere.

BRIEF DESCRIPTION OF THE INVENTION

The present invention in one form is a composite elastomeric friction element of a structure which permits the elastomer portion to be selected primarily with reference to its intended control function. Preferably, the elastomeric friction element consists of a block or mass of elastomeric material which is received in a bolster pocket located adjacent to a column guide wear surface, and a rigid metal member which is engageable with the elastomer and the column guide wear surface. With such a metal member, the portion of the elastomeric mass adjacent to the metal member is generally uniformly loaded both in shear and compression, and the metal member distributes the applied loading along the adjacent portion of the elastomeric mass. Further, a metal member can provide improved abrasion and wear resistance with respect to an imperfect column wear surface as compared to an elastomeric element directly engaging such an imperfect column wear surface. By isolating the elastomeric portion from the friction surface, the effects described above are significantly reduced and the elastomer deformation capabilites are distributed more uniformly over the entire elastomer volume. The elastomeric element thus can furnish a more optimum control of the relative motion between a bolster and the side frames of the truck by resilient deformation of the elastomer mass and further response characteristics prior to or concurrently with static friction break when sliding movement occurs between the friction element metal face and the column wear surfaces.

An additional preferred embodiment of the present invention resides in locating an elastomeric mass or element for controlling the relative motion of a bolster relative to column wear surfaces in spaced rleationship to the engaged column guide friction surfaces whereby the stress and heat effects arising at the engaged friction surfaces are additionally isolated from the elastomeric mass. Specifically, the elastomeric element is located between the inner surface of a bolster pocket and the member which biases a friction surface into engagement with a column wear surface. Such further spacing of the elastomeric element from the stress and heat generating friction surfaces permits the elastomeric material to be selected essentially on the basis of its elastic control capabilites since the problems associated with non-uniform stress and heat generation are substantially reduced or eliminated. Further, such location of the elastomeric element permits the elastomeric element to be geometrically and dimensionally optimized and reduced to the most economical volume.

Accordingly, a principal object of this invention is to provide a new and improved resilient elastomeric element for controlling relative motion between a bolster and side frame wear surfaces.

Another object of this invention is to provide a new and improved friction element for controlling relative motion between a bolster and side frame wear surfaces in which the elastomer provides more optimum bolster pocket load transfer to the friction element assembly with resulting more uniform wedge pressures on the column faces with less friction face wear, and the volume of a reslient elastomeric mass is essentially determined solely by the deformation properties of the elastomeric mass.

Another object of this invention is to obtain a new and improved friction assembly for a railway truck in which an elastomeric member provides an improved bolster pocket load transfer to the friction wedge to minimize bolster pocket wear.

Another object of this invention is to obtain a new and improved friction assembly for a railway truck in which an elastomeric member provides an improved bolster pocket load transfer to the friction wedge wherein relatively uniform pressures are exerted on the friction surfaces of the side frame columns.

Another object of this invention is to provide a new and improved friction element having a resilient elastomeric portion of a selected minimum mass which is sufficient to control the relative motion between a bolster and side frame wear surfaces.

Still another major object of this invention is to provide a friction element having a resilent elastomeric portion spaced from the engaged column guide friction surfaces.

Another object of this invention is to provide a friction element in which a metal friction face and a spring biased follower element may be combined in a single piece that can be cast or made from the same material.

Still another object of the invention is to provide a friction element which includes a resilient elastomeric portion of optimal mass and geometry determined solely on the basis of the resilient deformation properties of the elastomeric mass.

Yet another object of the invention is to provide a friction element including a resilient elastomeric portion which provides for maximum area of surface contact with one bolster pocket wall opposed to the column guide wear surface.

Another object of the invention is to provide a friction assembly which is adaptable to the geometry of a standard three-piece truck and within the limits of that geometry is able to provide improved modes of dynamic damping response including resilient flexibility in three dimensions.

A more specific object of the invention is to provide a composite friction element having rigid and elastomeric portions which fulfills the objects hereinabove set forth.

These and other objects and advantages of the invention will be better understood upon consideration of the following description with reference to the accompanying drawings, in which.

Figure 1:
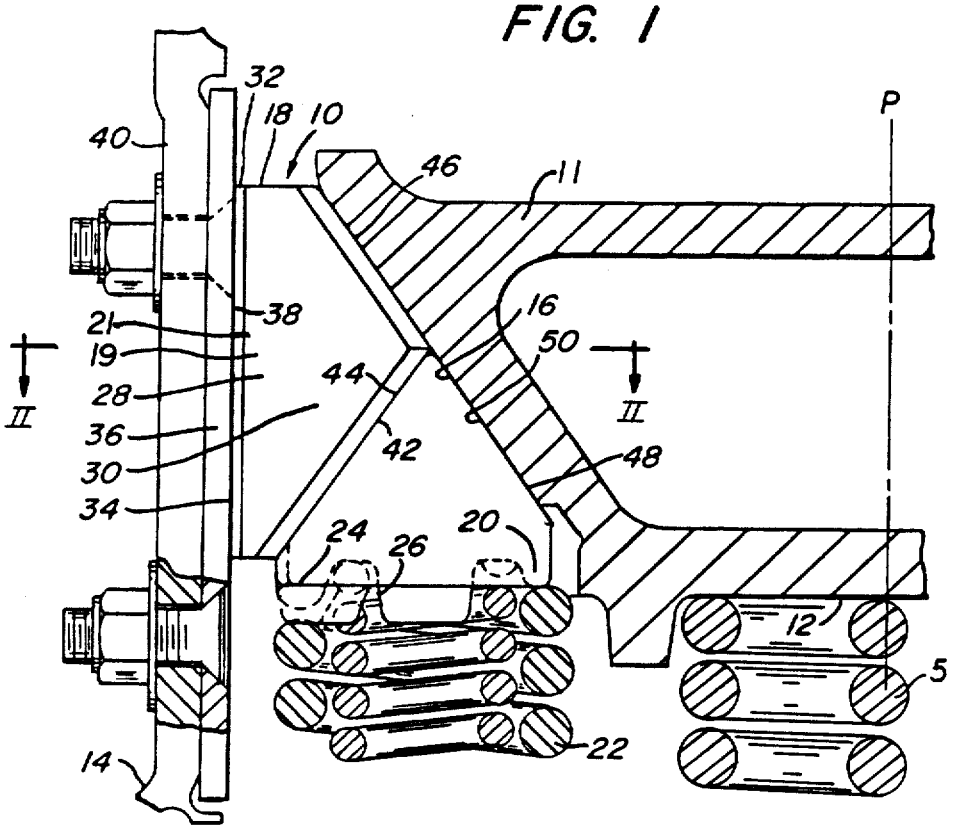
FIG. 1 is a partial side elevation and sectional view of one embodiment of a friction element assembly of the invention in operational position within a bolster pocket of a conventional three-piece railway truck.
Figure 2:
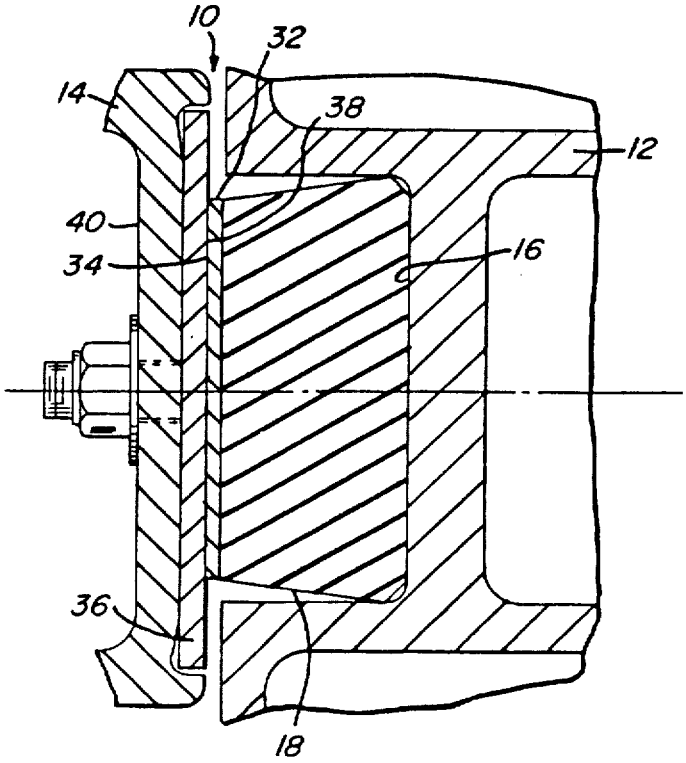
FIG. 2 is a cross-sectional view of the embodiment illustrated in FIG. 1 taken on line II—II of FIG. 1.

As is known and as is partially illustrated in FIGS. 1 and 2, a railway truck assembly bolster 12 is an elongated member having a pair of opposed outwardly open formed bolster pockets 16 located inwardly adjacent each of its ends and the open ends thereof facing in the direction of the longitudinal extent of the truck side frames. The oppositely facing open sides of bolster pockets 16 at each end of the bolster 12 are spaced inwardly of spaced wear plates 36 carried by respective opposed spaced column guide portions 40 of a side frame 14 in which the end portion of the bolster 12 is received in a known manner. Wear plates 36 are rigidly secured to column guides 40 in any suitable manner such as by being bolted or welded thereto. As shown, the wear plates 36 are secured to the column guides 40 by suitable bolt and nut assemblies having countersunk head portions with the outer ends of the heads being either flush or slightly recessed from the wear surface 38 of the wear plates 36 facing the adjacent sides of bolster 12. Thus, in the known railway truck assembly the outwardly facing open ends of the opposed bolster pockets 16 at each end of the bolster 12 are spaced inwardly of the respective wear surfaces 38. Each bolster pocket 16 extends diagonally downwardly and inwardly (with respect to a side of bolster 12) to provide a sloping surface 50 at the innermost extent thereof. Inasmuch as the structure of bolster 12 and side frame 14 as heretofore described are well known, further description thereof is not necessary to one skilled in the relevant art for the understanding of this invention.

Resilient elastomeric friction elements 18 are captively received in the upper portions of bolster pockets 16, respectively, and are retained therein by rigid metal spring biased followers 20 located in the lower portion of bolster pockets 16, respectively. Followers 20 are formed from any suitable material such as steel. Each illustrated follower 20 is a formed member which is generally triangular in cross section having an uppermost apex and a surface 48 extending downwardly and inwardly from the apex in engagement with surface 50. Each follower 20 further includes another surface 44 extending downwardly and outwardly from the apex in engagement with a complementary sloped surface 42 on element 18. The lowermost portion of each follower 20 is formed to captively receive the upper end of an elongated coil spring assembly 22, illustratively two coaxial coil springs. The lower end of each spring assembly 22 is suitably supported by an upwardly facing spring platform portion (not shown) of a side frame 14 as is well known.

Each elastomeric friction element 18 includes a formed elastomeric body 19 having an inner portion 30, which is triangular in cross section and an outer portion 28, which is generally rectangular in cross section with portions 28 and 30 being formed integrally with each other from an elastomeric material having operational capabilities as described herein. Portion 30 forms a surface 46 which is complementary with the upper portion of surface 50. A rigid metallic, such as steel, facing plate 32 is suitably secured to the outer, generally planar, vertically extending portion 28 of each elastomeric body 19 to extend generally vertically adjacent the wear plates 36, respectively, with outer vertically extending surfaces 34 thereof engaging respective wear surfaces 38. Facing plates 32 are secured to the respective outer surfaces of portions 28 of bodies 19 in any suitable manner, such as by a metal-to-elastomer bonding agent, such that the facing plates 32 do not slide relatively to the adjacent portions of the portion 28 of bodies 19, respectively. In a more preferable embodiment the members are in non-bonded frictional engagement.

As is known, the spring groups for supporting the ends of bolster 12 such as shown at S in FIG. 1, for example are designed such that the springs permit the ends of the bolster 12 to move relative to the side frames 14. Such relative movement can be vertical, horizontal or rotational, or in a direction having combined vertical, horizontal and rotational components. The elastomeric friction elements 18 are designed,(see the before identified patents), with a volume and configuration to be captively received as heretofore described. It will be realized that the deformation of each element 18, for either an empty or loaded car body, is the result of all of the forces applied to the element 18 by the mechanical system in which it is located. Thus, the weight of the spring supported bolster and an unloaded or loaded car body, exert a downward force via engaged surfaces 46 and 50 on elements 18 and respective followers 20. The bias of spring assembly 22 is transmitted through follower 20 to exert an upward force on friction elements 18 via engaged surfaces 42 and 46 as effected by the force existing between engaged surfaces 48 and 50. The forces applied through all these engaged surfaces cause normal and shear deformations with at least partial sliding and a resulting (compression) deformation of the elastomeric element parallel to surfaces 46 and 42. However, bodily sliding must occur eventually at the column wear surface 38 as sufficient vertical bolster to side frame force is applied to overcome the friction over the entire area of the interface between wear plate 36 and facing plate 32 when greater relative bolster to side frame motion occurs. Lateral bolster to side frame motion produces the same elastomer behavior with partial or even bodily sliding at the same surface interfaces in the lateral direction. Any relative motion direction which is a combination of vertical and lateral bolster motion components will produce corresponding elastomer responses. In addition, the angles at which surfaces 46, 48 and 50 and surfaces 42 and 44 extend with respect to a horizontal reference plane (not shown), and the spring force applied, also affect the magnitude of the force exerted on elements 18.

The sliding relative movement between surfaces 34 and 38 generates considerable heat due to the magnitude of the forces biasing surface 34 into engagement with surface 38. With the structure of this invention, the heat generated will raise the temperature of plate 32 and the elastomeric body portion 19 of the elements 18; however, due to the high heat conductivity of the material of plates 32, steel for example, the plate 32 serve both as a heat distributor and a radiant heat source. Thus, as the friction heat input to plates 32 increases, the temperature of plates 32 will increase and the heat will be rapidly conducted through interface 34 into wear plate 36 and thence in all directions from surfaces of side frame 14. All edges and surfaces of plates 32 exposed to ambient air dissipate heat to the ambient air. Thus, heat energy is dissipated by plates 32 immediately adjacent to the heat source, that is engaged surfaces 34 and 38, whereby the temperature of 32 is reduced and the heat transferred to elastomer portions 28 is reduced. Also, due to the high heat conductivity of plates 32, the heat transferred to elastomer portions 28 is distributed throughout the contact area of portions 28 with plates 32 thereby essentially eliminating localized high temperature areas or hot spots in portions 28.

Since plates 32 are rigid metal members, they also distribute the load applied to portions 28 fairly uniformly. Any load applied to a plate 32 will be more or less uniformly distributed over its entire attached or contacting area with elastomeric body 19. Due to the stiffness of plates 32 as compared to an elastomer, the resulting stress distribution, normal pressure and shear, at the interface of body 19 and plate 32 is more uniform since portions 28 are uniformly fixed to plates 32. Overstressing of portions 28 resulting from bunching of the elastomer no longer occurs. Since surfaces 34 and 38 are metal surfaces, they are less susceptible than the elastomer surface to damage due to initial surface roughness and imperfections in the column wear plate.

Although the generation of forces by the friction elements 18 as heretofore described is the most common, it is to be realized that the relative motions between a bolster 12 and side frames 14 are many and varied as determined by the actual conditions under which a freight car is operated. It is also to be noted that freight car trucks have known integral means to properly maintain the bolsters relative to the side frames 14 within prescribed limits. Regardless of the relative motion within the prescribed limits, the friction element of this invention maintains the bolster 12 relative to the side frames 14 as described until such time as the friction element 18 moves relative to the side frames 14. Also, although plates 32 may be uniformly bonded to portions 28 of the elastomer if desired, limited relative movement between a plate 32 and portion 28 may be premissible and still obtain the benefits of this invention. Thus, the cooperable surfaces of plates 32 and portions 28 can be mechanically interlocked where, some relative movement can still occur therebetween.

The elements 18 are designed to provide engagement between surfaces 34 and 38; 46 and 50; and 48 and 50 when the car body is loaded or empty; however, due to the additional weight of the loaded car on spring assembly 22 the biasing load applied to the elements 20 and 18 is of a proportionally higher magnitude for a loaded car. Alternatively, the biasing load from springs 22 may be substantially constant and remain the same for both loaded and empty operation if the lower seat supporting springs 22 are movable in concert with bolster 12.

In assembling the freight car the freight car body is placed on top of the truck assemblies whereby a portion of the weight of a car body is distributed to each end of bolster 12 to cause an initial downward movement of the bolster 12 and the spring supporting the bolster. Simultaneously the elastomeric body 19 of each element 18 is placed in compression between the inner sloping surface 50 of a bolster pocket 16 and the surfaces 42 of follower 20. The extent to which the elastomeric bodies 19 are compressed will be dependent upon the total downward movement of bolster 12. Such compression of the bodies 19 biases the plates 32 into engagement with wear plates 36 whereby the surfaces 34, 38 are in compressive engagement. Upon loading a freight car with cargo or lading such compressive force or bias is increased due to the increased weight. Thus, under conditions ranging from empty to fully loaded each elastomeric body 19 on each end of a bolster is essentially equally loaded and compressed to bias the surfaces 34 into engagement with wear surfaces 38. The essentially equal loading of the elastomeric portions is due to the same geometry for each element 18 and of the structure surrounding each element 18. Due to manufacturing tolerances, particularly since cast members are used, the geometry of the structure surrounding an element 18 may vary to a small degree and, accordingly, the compressive loading of the elastomeric bodies 19 may also vary slightly. Although the compressive loading of the elastomeric bodies 19 has been described as compressive loading, the elastomeric bodies 19 are also simultaneously loaded in shear as is more fully described hereinafter.

In operation a freight car is subjected to various force variations whereby the bolster 12 and side frames 14 move relative to each other. For ease in understanding this invention the operation of a loaded car with respect to initial vertical bolster and side frames relative movement will initially be described. As a loaded car travels over typical track, the car will be subjected to track conditions and resulting variations in force inputs which will cause the bolster to move relative to the side frames whereby the elastomeric bodies 19 can be further loaded in compression and shear. Such increase in compressive loading can continue until the friction force between the biased surfaces 34, 38 is overcome and the surface 34 moves over surface 38 in frictional engagement, i.e., breakaway between the surfaces 34, 38 has occurred. Normally a loaded bolster moves vertically with little or no relative rotation with respect to the side frames so that the plates 32 at each side of at least one of the bolsters move simultaneously and breakaway occurs essentially simultaneously. After breakaway occurs during relative downward bolster movement the downwardly moving elastomeric bodies 19 remain in compression and continue to still bias plates 32 into engagement with plates 36. Such downward relative movement of plates 32 with respective plates 36 continues until the plates 32 and 36 come to rest or until the bolster starts to move upwardly with respect to the side frames.

In the event the downward relative movement of the bolster is reversed prior to the occurrance of downward breakaway, the plates 32 and 36 will remain stationary. The compressive and shear loading of the elastomeric bodies 19 will immediately start to decrease. Such decrease in compressive loading does not, however, cause the bias on plates 32 and 36 to be released due to the resiling characteristics of the elastomeric material of bodies 19. Resiling is the characteristic of a body to attempt to return to its original non-stressed state such as its free body state. During such resiling the elastomeric bodies 19 maintain a bias (which is decreasing) between the plates 32, 36 to retain plates 32, 36 relatively stationary until such time as the bias of elastomeric bodies 19 is sufficiently reduced and the force of springs 22 becomes sufficient to move the friction assemblies 18 upwardly. Such resiling period while plates 32 and 36 remain stationary is an important aspect of this invention. With the elastomeric material of bodies 19, the bodies 19 will initially resile with the chracteristic straight line or near linear behavior of an elastic member. However, also due to the characteristics of the selected elastomeric material for body 19, after such initial straight line resiling is completed the elastomeric bodies 19 will resile at an increasing rate as at least portions of surfaces 46 slide over surfaces 50. Such surface 46, 50 sliding, after once being initiated, will occur over larger areas of the interface as the compressive loading continues to decrease and strain recovery occurs throughout a larger portion of the elastomeric volume of body 19. Thus, at the end of the resiling period bodies 19 are resiling at a higher rate to maintain engagement between plates 32, 36 as breakaway is initiated. During such initial resiling the surfaces 46 of the elastomeric bodies 19 do not have any substantial degree of movement relative to the sloping surfaces 50 of the bolster; however, as resiling continues the characteristics of the elastomeric material are such that surfaces 46 start to move over surfaces 50 and after such movement has occurred the rate of such movement gradually increases until such time as the spring set 22 causes the friction elements 18 to move bodily upward with respect to the side frames, i.e., partial sliding of the surface 46 with respect to the surface 50 as hereinafter more fully described. Thus upon relative upward movement between the bolster and side frames the friction elements 18 remain in biased engagement with plate 36 through an initial period of upward bolster movement while the elastomeric bodies 19 are resiling. Accordingly, during such resiling period the bolster, friction elements and side frames are in cushioned engagement and thus the impact damage of sudden relative motion accelerations is reduced. Further, just prior to upward movement of the friction elements 18, the rapid resiling of the elastomeric elements permits a smooth transition from plates 32, 36 being relatively stationary to plates 32, 36 starting to move relative to each other.

The same type of resiling action occurs when the bolster moves upwardly from a lower position at which the supporting springs 22 are fully compressed; however, the resiling will be for a longer period of time due to the higher compressive loading of the elastomeric bodies 19. The same type of resiling action occurs when the bolster moves upwardly under an empty freight car; however, the resiling period will be shorter due to the lower compressive loading of the bodies 19.

The same type of cushioning action occurs when the bolster moves relatively downwardly with respect to the side frames prior to downward breakaway and depending on the extent the bodies 19 are compressed. Upon such relative downward movement and with plates 32, 36 initially being stationary, the compressive loading on the elastomeric bodies 19 increase with the straight line behavior of an elastic member under initially increasing compressive loading with surfaces 46, 50 being relatively stationary. As the compressive loading continues to increase, the elastomeric bodies 19 deform with surfaces 46 moving partially over surfaces 50 which, once started, sliding occurs over a larger area of the interface and at an increasing rate of movement. Such movement of the elastomeric bodies 19 with the higher compressive loading produces a result similar to the movement of the elastomeric bodies 19 during the second resiling stage above discussed. (Also discussed in more detail hereinafter.) Thus, again the bolster, friction elements and side frames remain in cushioned engagement until the friction elements 18 start to move downwardly with respect to the side frames. Again due to the partial movement of surface 46 over surface 50 at an increasing rate a smooth transition is obtained as plates 32, 36 move from a stationary position into a relatively moving mode. Such described behavior is the same for any increased compressive loading on the elastomeric bodies 19 with plates 32, 36 initially being relatively stationary; however, the period required to so compress the elastomeric body 19 will vary depending on the initial compressive loading on the elastomeric body 19 to be further compressed.

In the situation where a compressed elastomeric body 19 is resiling it is quite possible that the relative upward movement of the bolster may suddenly change to relative downward movement. Under such circumstances the loading on the elastomeric bodies 19 will immediately shift from the characteristics of a resiling member to the characteristics of a member being compressed. Thus, the cushioning previously discussed continues even though the loading on the elastomeric bodies 19 changes from decreasing to increasing compression. Similarly it is quite possible for the elastomeric bodies 19 to be alternately resiling and compressed for a period of time without relative movement occurring between plates 32, 36. Under such circumstances the cushioning previously described can be provided over a range of vertical bolster force changes that are less than the sliding friction between plates 32 and 36.

Under normally encountered force loading of the elastomeric bodies 19 one end of the bolster will move simultaneously with respect to the supporting side frame. Thus, at least two elastomeric portions are normally loaded (compression) or unloaded (resiling) simultaneously; however, three or four elastomeric bodies 19 can also be simultaneously loaded and unloaded depending on operating conditions. The same cushioning as described for relative vertical movement is obtained upon relative lateral and/or rotational movement between a bolster and side frames since plate 32 is capable of sliding laterally or rotating with respect to plate 36.

Very substantial advantages are also obtained with the elastomer behavior in providing more uniform forces between plate 32 and plate 36. Primarily, since surfaces 34, 38 are surfaces of metal plates 32, 36 a fairly consistent friction force is generated therebetween over the desired operating temperature range. More consistent friction forces provide for more uniform operation of the friction elements 18. Also, since plates 32, 36 are metal, higher friction forces can be generated therebetween than are obtainable with a non-metallic member engaging a metal surface. In fact higher, more uniform pressures can be practically obtained between plate 32 and plate 36, without the rapid deterioration due to bolster pocket camming and overstrain. Such higher more uniform pressures result in higher friction damping forces than can be obtained with state of the art rigid friction wedge configurations.

Figure 3:
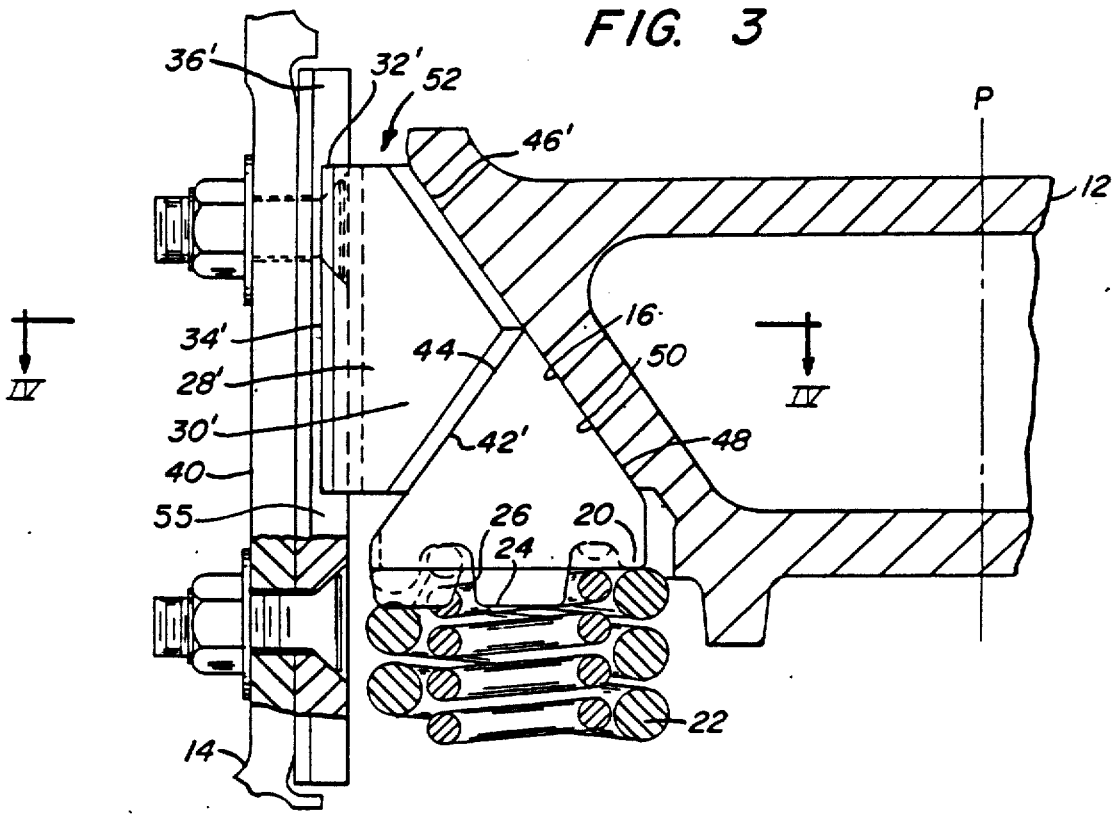
FIG. 3 is a partial side elevation and sectional view of another embodiment of a friction element assembly of the invention in operational position within a bolster pocket of a conventional three-piece railway truck with an alternate geometry for control of lateral or transverse bolster to side frame motion.
Figure 4:
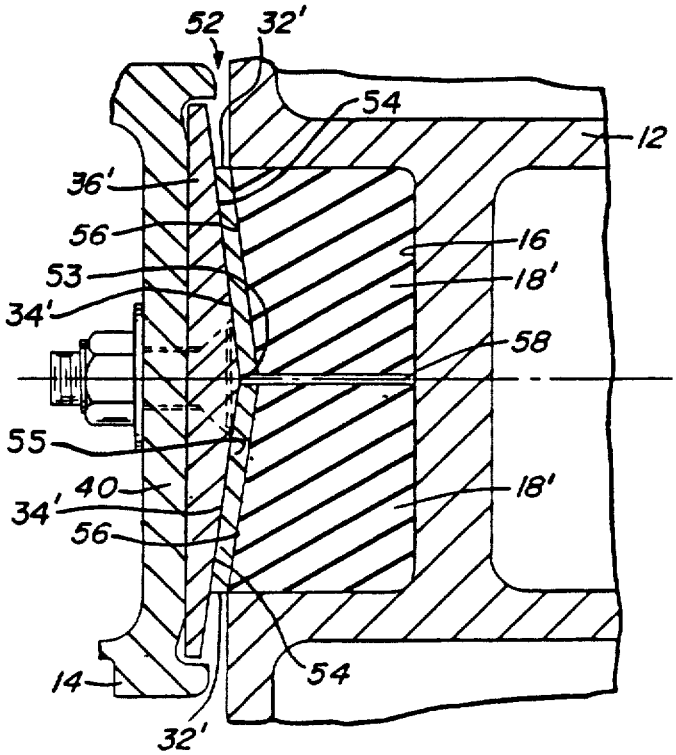
FIG. 4 is a cross-sectional view of the embodiment illustrated in FIG. 3 taken on line IV—IV of FIG. 3.

In FIGS. 3 and 4, an alternative to the embodiment of FIGS. 1 and 2 is shown in that a friction assembly 52 is provided with many of the structural and operational characteristics of friction assembly 10 discussed hereinabove with reference to FIGS. 1 and 2. Accordingly, in FIGS. 3 and 4 like elements will be identified with like numerals and similar elements will be identified with like numerals primed.

The friction assembly 52 is similar to the elastomeric friction assembly illustrated in applicant's U.S. Pat. No. 4,295,429. Accordingly, a detailed description of the generally identical structural and operational features thereof is not necessary for a full understanding of this invention. The illustration and brief description of the friction assembly 52 is included herein to illustrate the scope and varied applications possible with applicant's present invention as the invention herein may be applied in a broad range of prior friction assembly designs.

Friction assembly 52 comprises, as shown, a pair of identical, laterally spaced (as at 58) adjacent elastomeric friction members 18' which are cooperable with a suitable follower member 20 and coil spring assemblies 22. A wear plate 36' is suitably secured to the column guide 40. An inwardly facing, generally vertically extending surface 55 of wear plate 36' consists of a pair of transversely adjacent, noncoplanar surface portions 54 which extend transversely outwardly from their intersection or apex 53. Apex 53 preferably coincides with the transverse midpoint of wear plate 36'. The surface portions 54 diverge outwardly from apex 53 with respect to the central plane P of bolster 12.

A generally vertically extending, outermost surface 56 of each portion 28' also diverges transversely outwardly such that surfaces 56 are parallel to the respective adjacent transverse surface portions 54. A rigid, metal faced plate 32' having an outwardly facing surface portion 34' is suitably secured to each of surface portions 56 such that in the assembled configuration a friction interface is established between the adjacent surface portions 54 and 34'. With a friction assembly 52 as shown in FIGS. 3 and 4, all of the advantages of the elastomeric friction assembly described in U.S. Pat. No. 4,295,429 are maintained while simulatenously acquiring the advantages of the present invention in the same manner as was discussed hereinabove with reference to the friction assembly 10.

Figure 5:
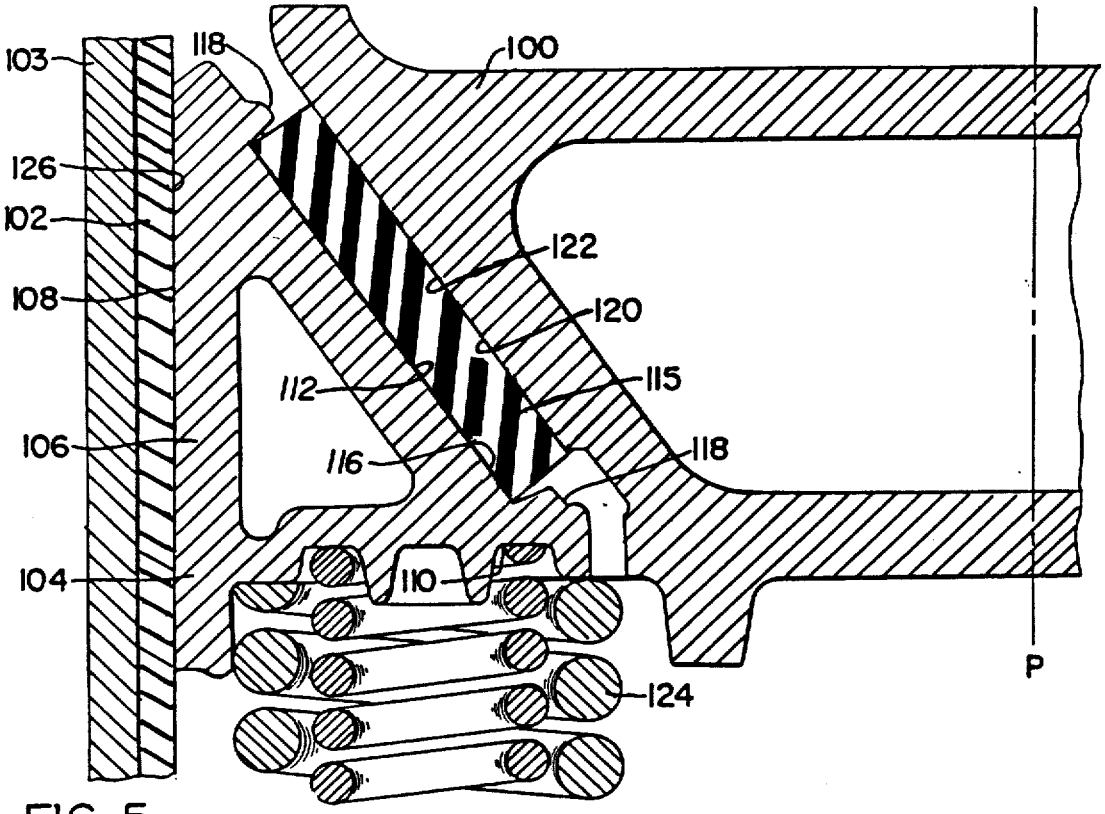
FIG. 5 is a partial side elevation and sectional view of another embodiment of the invention wherein an elastomeric friction element is located in a bolster pocket in spaced relationship from the engageable metal friction surfaces of the column guide wear plate and is shown in an unloaded or undeformed state.

The following additional alternative embodiment will serve to further illustrate the broad nature of the invention. Referring to FIG. 5, there is shown a fragmentary portion of a bolster 100 positioned in proper fitup with a side frame of a standard three-piece truck with a friction assembly 104 disposed in part within a bolster pocket 122 and in engagement with a column guide wear plate 102 which is suitably secured to a column guide 103 of the side frame.

Friction assembly 104 includes a generally wedge shaped rigid body member or friction shoe 106 which includes a generally outwardly facing friction surface 108, a generally downwardly facing formed spring retainer face 110 and an inwardly facing, generally inwardly and downwardly sloping, formed elastomer retaining face 112. An elastomeric element 115 is received in a recess 116 formed within the confines of abutments 118 on face 112 and is retained therein by any of a variety of retention mechanisms to be described hereinbelow. The retention of elastomeric element 115, as shown in FIG. 5, is achieved by captively retaining element 115 intermediate face 112 of shoe 106 and an adjacent, generally ourwardly facing, innermost surface 120 of bolster pocket 122, which may be the innermost wall of a standard bolster pocket for receiving a conventional rigid friction assembly. Elastomeric element 115 is secured in the position described by coil spring assembly 124 which engages face 110 to urge friction assembly 104 upward such that elastomeric element 115 is biased into frictional engagement with surface 120 and friction surface 108 of rigid body 106 is biased into frictional engagement with a wear surface 126 of wear plate 102.

As is known, retention spring assembly 124 is maintained in compression between face 110 and a side frame spring seat (not shown) or between face 110 and a formed retention spring seat portion (not shown) of bolster 100. In the former configuration, retention spring bias varies with relative vertical motion between the bolster 100 and the side frame whereas in the latter configuration the retention spring bias for any given spring assembly 124 is established by the spacing between the bolster retention spring seat portion (not shown) and the spring retention face 110 of an engaged friction assembly 104. This choice between alternative modes of retention spring installation is available for any contemplated embodiment of the invention herein.

The embodiment of FIG. 5 provides for a desirable uniformity and consistency of loading and frictional response. In addition, the elastomeric element 115 provides the desirable advantages of elastic deformation, as hereinabove described, for enhanced dynamic damping of force inputs to the bolster. The mode and magnitude of the elastic deformation response depends not only upon the physical properties of the elastomer used such as its shear and compression moduli of elasticity, its size and geometry, but also upon the manner of its retention with respect to rigid body 106. For the embodiment of FIG. 5, the elastomeric element 115 is captively retained within recess 116 by abutments 118, and is frictionally engaged with major portions of surfaces 112, and 120.

Figure 6:
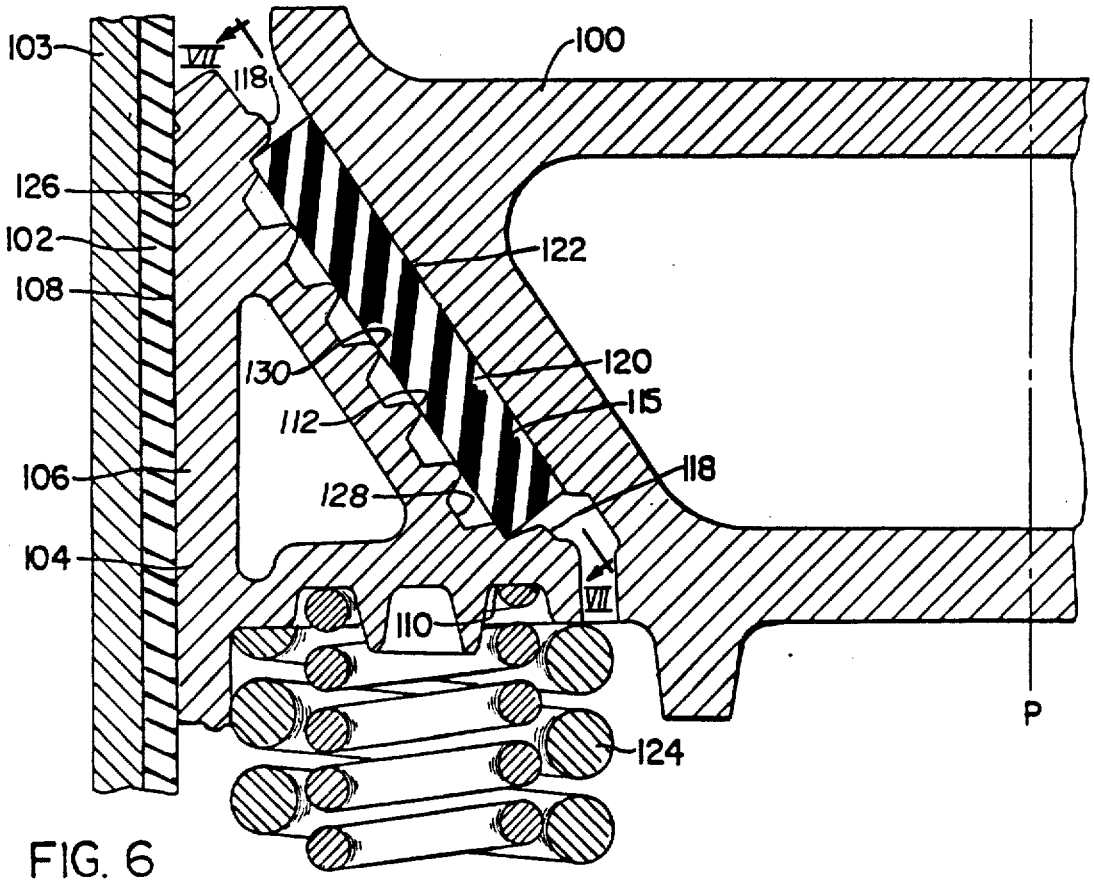
FIG. 6 is a partial side elevation and sectional view similar to FIG. 5 and showing a variation in the retention of the elastomeric element of the FIG. 5 embodiment.
Figure 7:
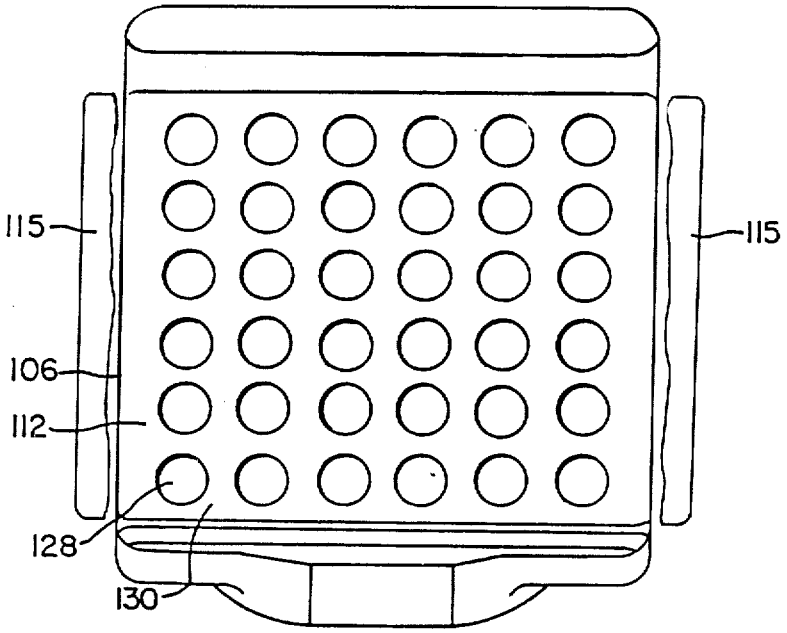
FIG. 7 is a partial elevation taken on line VII—VII of FIG. 6 with the elastomer mass broken away and showing an elevation of the elastomeric element retention means of FIG. 5.

In FIGS. 6 and 7, there is shown a modification of the FIG. 5 embodiment wherein surface 112 of rigid body 106 includes a plurality of formed cavities 128 and intervening abutments 130 which function as shear abutments. The outwardly facing surface area of elastomeric element 115 is cooperably formed to interfit or interfit with cavities 128 and abutments 120 to provide a mechanical interlock between rigid body 106 and elastomeric element 115. This alternate mode of elastomer retention provide for modified distribution of forces, notably shear forces, along the interface between elastomeric element 115 and rigid body 106 at surface 112. Sliding of element 115 is thus limited by the interlocking shear of the element 115 with abutments 130.

Still further embodiments of the invention are shown in FIGS. 9–16 to illustrate the broad nature of the invention. All of the above description relating generally to operating characteristics, benefits derived, design parameters and limitaions, and other considerations, applies in essence to the following described embodiments as well.

These further embodiments concern certain modifications of the above described embodiments (FIGS. 9–12), and application of the invention in single axle truck (FIGS. 13 and 14) which, like the three-piece trucks of all the above described embodiments, are well known in the railway rolling stock art. The FIGS. 15 and 16 embodiment relates to a friction element with a retention spring captive within the bolster that produces a substantially constant spring bias preload at the engaged friction element surfaces.

Figure 8:
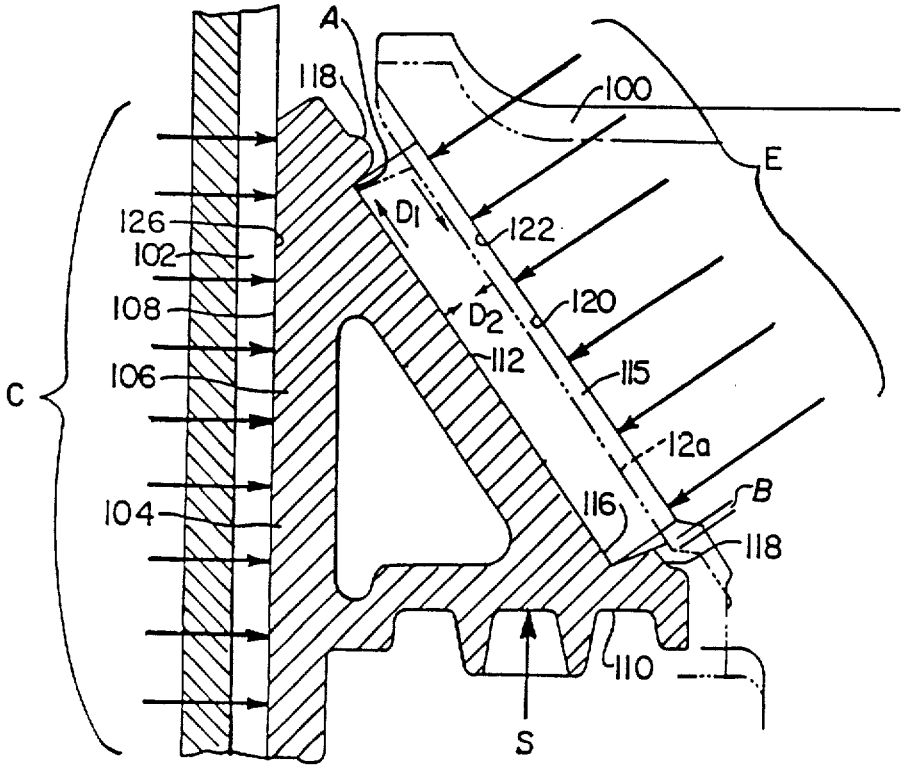
FIG. 8 is a partial side elevation and sectional view similar to FIG. 5 showing the elastomeric element in a loaded or deformed state.
Figure 9:
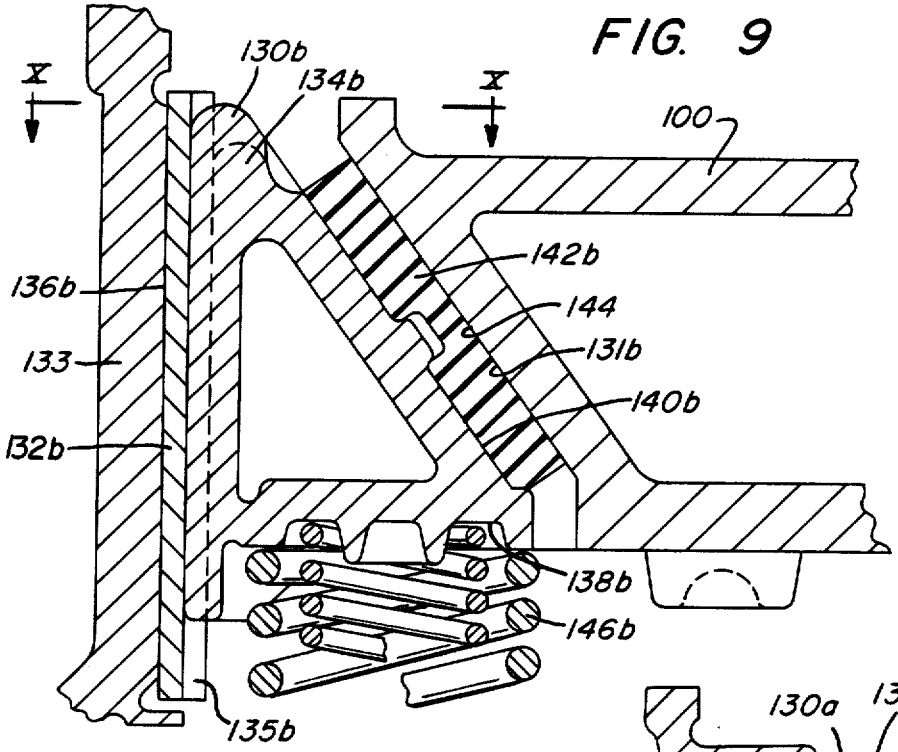
FIG. 9 is a sectioned, partial side elevation of another embodiment of the invention taken on line IX—IX of FIG. 10.
Figure 10:
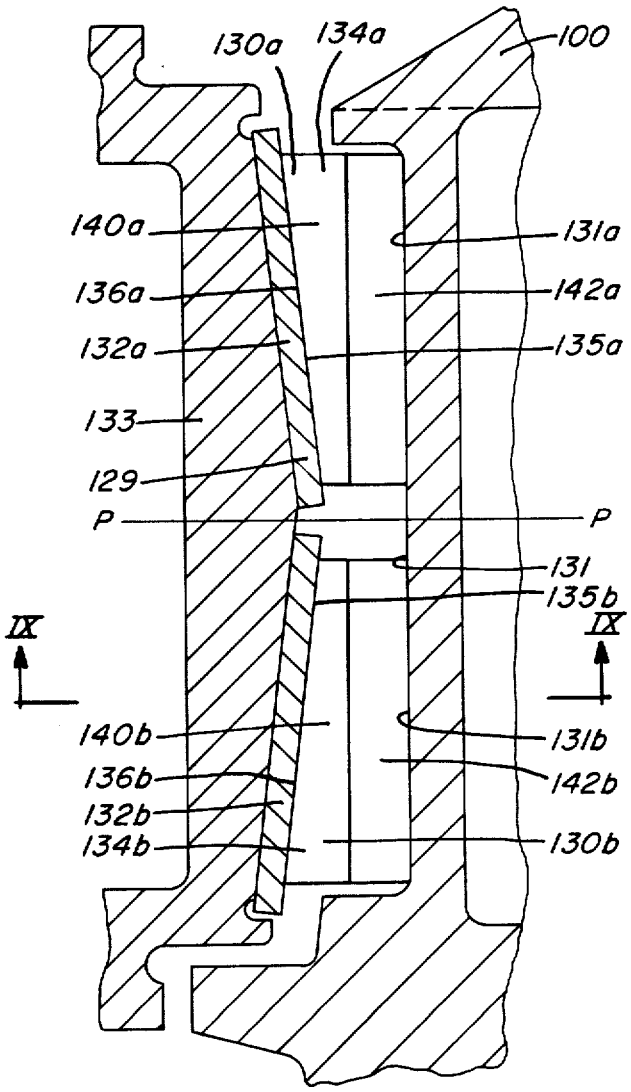
FIG. 10 is a sectional top view taken on line X—X of FIG. 9.

In FIGS. 9 and 10 there is shown a railway truck bolster friction assembly which is similar in many salient respects to the embodiments of FIGS. 5 through 8, in that the bolster 100 is positioned in fitup with a side frame of a standard three-piece railway truck by a friction means comprised of a pair of friction shoes **130*a*, 130*b*, only one of which is shown in FIG. 9**.

Each friction assembly **130*a*, 130*b*, is disposed within a bolster pocket 131 and engages a respective portion 132*a*, 132*b*, of a column guide wear plate means 129 which is suitably secured to a column guide 133 of the side frame. Each friction assembly 130*a*, 130*b*, includes a generally wedge shaped rigid body member 134*a*, 134*b*, these rigid body members being disposed in adjacent side-by-side relationship within respective side-by-side portions 131*a*, 131*b*, of pocket 131 such that they are symmetrical about the vertical plane P—P in FIG. 10. Plane P preferably is the central longitudinal plane of the side frame. The detailed description hereinbelow, although referring to only friction assembly 130*b* also applies to the other friction assembly 130*a* which is the mirror image of assembly 130*b***.

Member **134*b* includes a generally outwardly facing friction surface 136*b*, a generally downwardly facing formed spring retainer face 138*b*, and an inwardly facing, generally inwardly and downwardly sloping, formed elastomer retaining face 140*b*. A resilient elastomeric element 142*b*, is positioned adjacent face 140*b* within the respective pocket portion 131*b* and is retained with respect to face 140*b* by any of a variety of retention mechanisms such as those described hereinabove, and by the captive biasing thereof intermediate face 140*b* and an innermost sloping wall 144 of pocket portion 131b. For example, a coil spring assembly 146b engaging face 138b functions in the manner described hereinabove with reference to the FIGS. 5–8 embodiments to retain the friction shoe 130b by biasing same into engagement with pocket wall 144 and a wear surface 135b of a wear plate 132b**.

Additionally, the biased retention of friction shoe 130b preferably provides advantageous self-centering and wear take-up characteristics in much the same manner as the FIG. 4 embodiment in that the column guide wear plates 132a, 132b, incorporate respective wear surface portions 135a and 135b which diverge laterally from bolster 100 and are engaged by the complementary friction surfaces 136a, 136b of the respective rigid members 134a, 134b. The lateral slope or divergence between pocket wall 144 and the respective wear surface portion 135a causes each shoe 130a, 130b, when under the described spring bias load, to be biased outwardly toward its extreme limit for wear takeup. Under such conditions the lateral spaces shown between 142a, 142b and the sides of the bolster pocket as shown in FIG. 10 need not exist. The lateral slope of wear surface portions 135a, 135b also provides the same sort of self centering characteristic as described hereinabove with reference to FIGS. 3 and 4 in that an off-center condition results in an incremental increase in the compressive deformation of one of elastomeric members 142a, 142b, and a corresponding incremental decrease in the compressive deformation of the other, so as to urge the bolster 100 toward a balanced or centered position with respect to the side frame where the compressive deformation of the members 142a, 142b is essentially equal.

Figure 11:
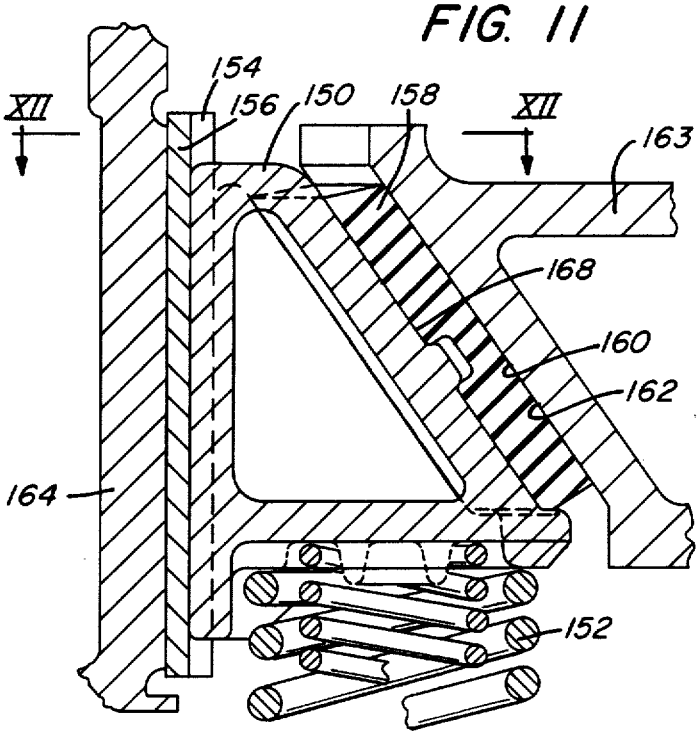
FIG. 11 is a sectioned, partial side elevation of another embodiment of the invention taken on line XI—XI of FIG. 12.
Figure 12:
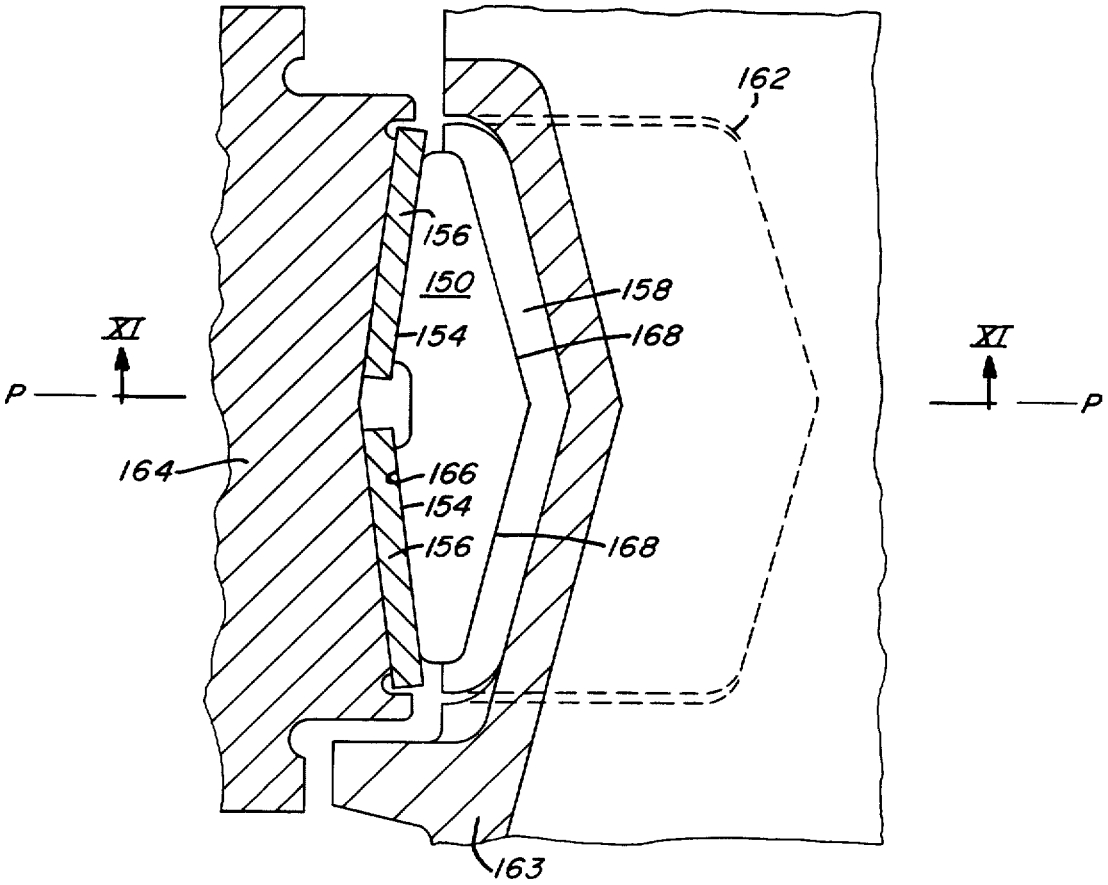
FIG. 12 is a sectional top view taken on line XII—XII of FIG. 11.

FIGS. 11 and 12 illustrate an embodiment which is similar in many respects to that of FIGS. 9 and 10 and which provides many of the same advantages and features; however, in this embodiment a single, generally wedge shaped rigid member or friction shoe 150 is retained by a corresponding compression spring assembly 152 in biased engagement with wear surfaces 154 of column guide wear plates 156. An elastomeric element 158 is located between member 150 and a sloping inner wall 160 of a pocket 162 in a bolster 163. The side frame column guide 164 and the wear plates 156 mounted thereon are so configured that the laterally opposite sides of wear surface 154 converge laterally from a central location toward pocket 162. The friction surface 166 of rigid member or shoe 150 is similarly configured for complementary frictional engagement with surfaces 154.

Likewise, the inner wall 160 (FIG. 11) of pocket 162 has side portions which extend laterally from a central location and converge toward wear surface 154. The adjacent surface portion 168 of shoe 150 is cooperably configured. The elastomeric member 158 is of a generally chevron shaped configuration in horizontal section planes to be accomodated within pocket 162 adjacent surface 168 such that it may be maintained in biased engagement by spring 152 with surfaces 160 and 168.

The described lateral slope of surfaces 154, 166, 168 and 160, and the cooperating chevron shape of resilient elastomeric member 158, all serve to provide a beneficial self centering effect substantially as above described with reference to the FIGS. 4–5 and FIGS. 9–10 embodiments. Accordingly, when bolster 163 is positioned laterally off-center with respect to the side frame, the differential compression of elastomeric member 158 on opposite sides of the central vertical plane indicated by line P—P in FIG. 12 imposes a lateral force differential that tends to restore the bolster and side frame to a mutually centered configuration. As in all other described embodiments of the invention, the mutually cooperable configurations of rigid shoe member 150, elastomeric member 158, and pocket 162 serve to confine elastomeric member 158 while allowing resilient deformation thereof, and to control relative motion between bolster 163 and the side frames as heretofore described.

Figure 13:
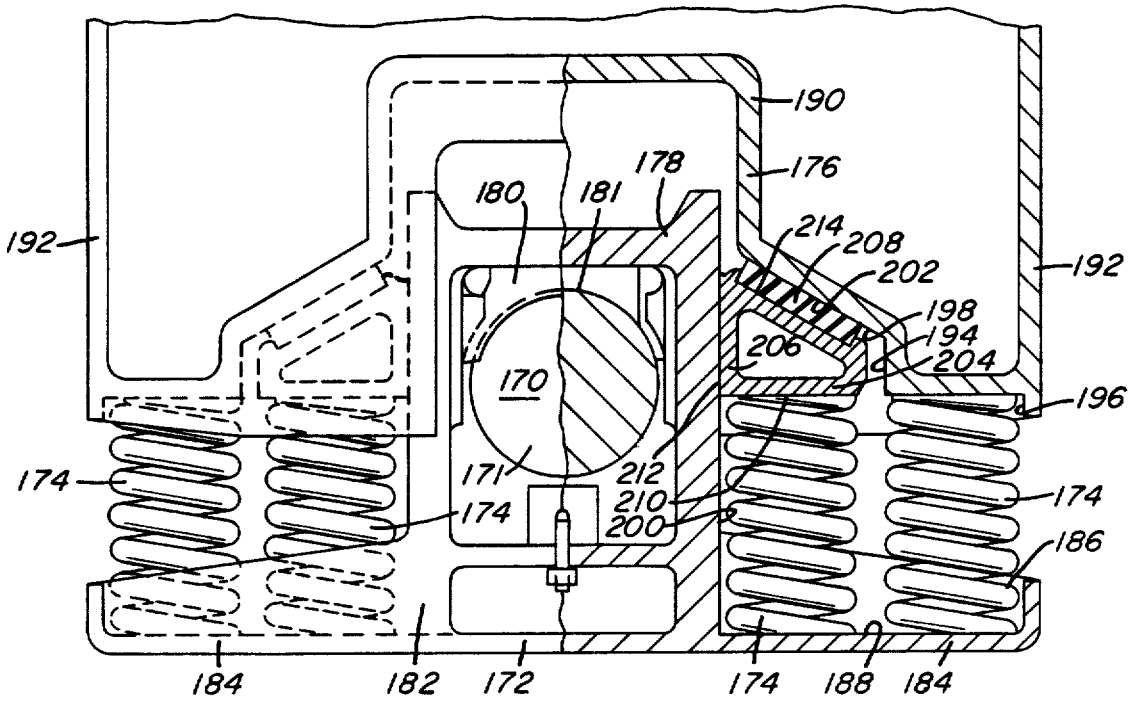
FIG. 13 is a partially sectioned side elevation of a single axle railway truck showing a further embodiment of the invention.
Figure 14:
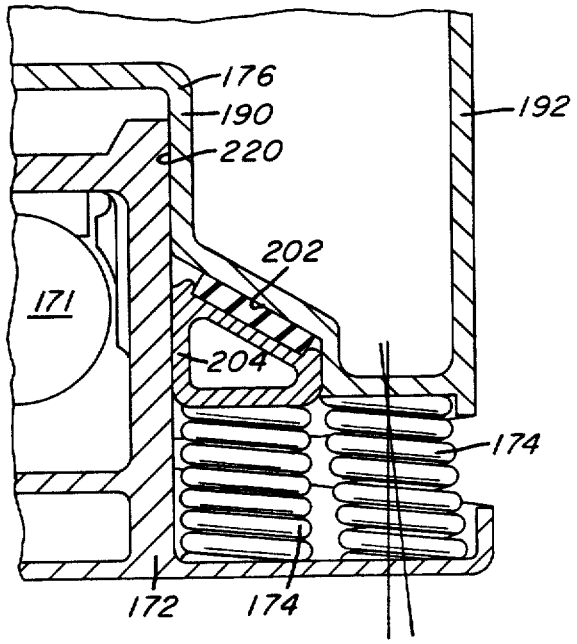
FIG. 14 is a view similar to the sectioned portion of FIG. 13 showing parts of the single axle truck in relatively shifted positions.

The invention herein also may be embodied in other railway truck structures, a single axle truck for example, to provide fitup and control of relative motion between a car body suspension frame and a wheel set from which the car body is suspended. Such an embodiment is shown in FIGS. 13 and 14 as a single axle truck comprising a well known wheel and axle set 170 having conventional flanged wheels (not shown) mounted on an axle 171. A pedestal frame 172 is supported with respect to wheel set 170 for rotation of the wheel set with respect thereto, and pedestal frame 172 in turn supports a plurality of coil springs 174. A car body suspension frame, partially shown at 176, is rigidly secured with respect to a conventional car body (not shown) and frame 176 is in turn supported upon springs 174 for sprung suspension of the car body with respect to wheel and axle set 170. Of course, such a single axle truck will be located adjacent each end of an elongated car body and each will comprise laterally spaced sets of suspension frame and pedestal members as above described for spaced support of the car body at points adjacent the opposite longitudinal ends of each wheel and axle set 170.

More specifically, each pedestal frame 172 is a rigid, preferably unitary structure comprising a bearing housing portion 178 which receives a bearing adaptor 180 for relative rotary support of the pedestal frame 172 with respect to a rotary bearing portion 181 of axle 171. A depending portion 182 of housing portion 178 projects downwardly of axle 171 and merges with elongated spring retention and support portions 184 which project outwardly from axle 171 in opposite longitudinal directions with respect to the longitudinal extent of the car body. Each spring retention portion 184 defines an upwardly opening spring receiving pocket 186 having a seat 188 upon which is supported a plurality of the coil springs (or spring assemblies) 174.

Frame 176 comprises a rigid, preferably unitary structure which includes a central portion 190 that generally overlies and encompasses bearing housing portion 178 of pedestal frame 172, and depending side portions 192 that generally overlie spring receiving pockets 186 of pedestal frame 172. Each of side portions 192 defines a generally downwardly opening pocket 194 which is comprised of an outboard pocket portion 196, and an inboard pocket portion 198.

Outboard pocket portions 196 receive the upper ends of one or more springs 174 whereby the car body is provided with sprung support with respect to wheel and axle set 170. Each inboard pocket portion 198 is located laterally adjacent a generally vertically extending side wall surface 200 of pedestal housing portion 178, and each includes a generally upwardly and inwardly sloping inclined surface 202 which forms an acute angle with surface 200. A friction assembly 204 of complementary form is received into each inboard pocket portion 198 and is retained therein in biased engagement with surfaces 200 and 202 by a spring or spring assembly 174.

Each friction assembly 204 comprises a rigid, generally wedge shaped friction shoe 206 and a resilient elastomeric member 208. Rigid member 206 is provided with exterior surface portions to accommodate spring biased retention of the friction assembly 204 in engagement with surfaces 200 and 202. A spring engaging surface portion 210 comprises a formed face which is adapted for biased engagement with an axial end of spring or spring set 174. A primary friction surface portion 212 is adapted and oriented for biased friction engagement with surface 200 to provide a frictional damping of relative motion between frame 176 and pedestal frame 172. An elastomer retaining surface portion 214 of rigid member 206 is oriented with respect to surface portions 210 and 212 such that, when member 206 is positioned on a spring 174 with surface 212 thereof engaging surface 200, the surface 214 is generally parallel to inclined surface 202 whereby elastomeric member 208 may be captively retained intermediate surfaces 202 and 214.

From the above description, it will be appreciated that a compressed spring 174 is able to retain a friction assembly 204 in pocket 198 with surface portion 212 in biased frictional engagement with surface 200 and with elastomeric member 208 maintained in compression by the weight of the car body and suspension frame exerted through friction assembly 204 upon the associated spring 174.

All of the details regarding manner of operation, variation of elastomer retention structure, friction shoe and elastomeric pad configuration, and the like as above described with reference to other embodiments, are applicable to the present embodiment also. This embodiment of the invention offers further advantages not contemplated by other embodiments described herein. Specifically, a single axle truck such as shown in FIG. 13 requires a steerable axle and wheel set 170 due to the relatively long span between axles. That is, for any given track curve radius, the angle between radially positioned axles becomes greater as the axles are spaced progressively further apart. Thus, the freedom of movement required to allow axles at opposite ends of a car to assume a true radial orientation is much greater than that required for the axles of a twin axle three-piece truck. Since the standard three-piece trucks rotate independently with respect to the car body, only the span between axle centers in any given truck is of significance in this regard. The truck of FIGS. 13 and 14 must accommodate the greater requisite freedom of movement for axle steering as well as all other modes of relative movement to which the other embodiments described hereinabove are subject. In addition, the single axle truck accommodates a varying friction force between surfaces 200 and 212 as springs 174 deform and resile under load, as well as longitudinal shifting of pedestal frame 172 with respect to frame 176, and limited axial rotation of pedestal frame 172.

As shown in FIG. 14, pedestal frame 172 may shift longitudinally with respect to frame 176 between stops defined by interior wall portions 220 of frame central portion 190. Such shifting also occurs when axle 171 assumes a radial position on curved track, but the direction of movement of axle 171 is in opposite directions with respect to the frames 176 at laterally opposite sides of the car body. That is, as one end of the axle 171 moves forward, the opposite end moves rearward. In such an instance the axle 171 and associated pedestals are cocked or angled (i.e. out of square) with respect to the respective frames 176.

In FIG. 14, the axle 171 is shown in an extreme off center position, the limit of which is defined by engagement of pedestal frame 172 with surface 220 as mentioned. In this configuration, the friction assembly 204 has been forced down the slope of surface 202 thus incrementally compressing the associated retention spring 174. The friction assembly on the opposite side of pedestal frame 172 (not shown) has similarly been permitted to ride up the slope of its restraining surface 202 under the bias of its respective retention spring 174 as the spring resiles incrementally. The result is an imbalance in friction member retention bias which produces a net lateral restoring force to oppose movement of pedestal frame 172 from a central position with respect to frame 176. In addition, the described lateral shift also forces the main suspension springs 174 in outboard pockets 196 to flex laterally as shown. Therefore, these springs 174 also exert a restoring force which complements the restoring or centering action of friction assemblies 204.

The described differential compression of friction element retention springs 174 is supported by pedestal 172 and frame 176. Therefore, pedestal 172 has a tendency, under such side-to-side differential spring compression, to rotate with respect to frame 176 about axle 171. The described truck structure will accommodate such relative rotary motion within limits defined by the limit of rotary motion of pedestal bearing housing portion 178 within frame central portion 190.

From the above description it will be appreciated that the functional capabilities of the single axle truck require various modes of relative motion between the pedestal and frame components. Often the requisite relative motion may result in a pedestal-to-suspension frame orientation that would not accommodate a rigid friction member without considerable misalignment, possible binding, uneven wear, and periods of ineffective operation as when the relative positions of frame and pedestal force large portions of the primary friction interface areas to separate. Accordingly, the elastomeric element 208, with its ability to deform under load, permits the single axle truck to accommodate the described relative motion while maintaining a relatively uniform load distribution without suffering any of the normally attendant drawbacks. The elastomeric element 208 also functions as in the other described embodiments to control friction break at the metal to metal friction interface. Accordingly, a superior and heretofore unattainable combined damping and steering effect is available.

A further embodiment of the invention contemplates an arrangement similar to that shown in FIGS. 13 and 14 in that the friction assembly receiving pockets open longitudinally inward or toward each other and the friction assemblies received therein are maintained in biased frictional engagement with wear surfaces which face longitudinally outward in confronting relation with the respective pockets. In such an arrangement as above described with reference to FIGS. 13 and 14, the pockets are formed in a car body supporting member and the corresponding wear surfaces are provided on elements supported by an axle-carried member which supports the load springs and the friction assembly retention springs, just as in a standard three-piece truck.

Such an arrangement is also known in a three-piece truck having friction assembly receiving pockets 410

(FIG. 17) formed in side frames 412 to open longitudinally inward or toward one another and toward a bolster end (not shown) that is received in a space 414 therebetween. Respective wear surfaces provided on the bolster ends face longitudinally outward in confronting relationship with the respective pockets 410. Accordingly, the relative orientation of the friction assembly receiving pockets and respective wear surfaces as disclosed in the FIG. 13 and 14 embodiments is not limited to single axle trucks but is also contemplated for known three-piece trucks; however, in such a three-piece truck with side frame pockets 410, the longitudinally inwardly facing pockets are formed in the axle-carried member and the confronting wear surfaces are formed on the car body supporting member, unlike the FIG. 13 and 14 embodiment.

Figure 17:
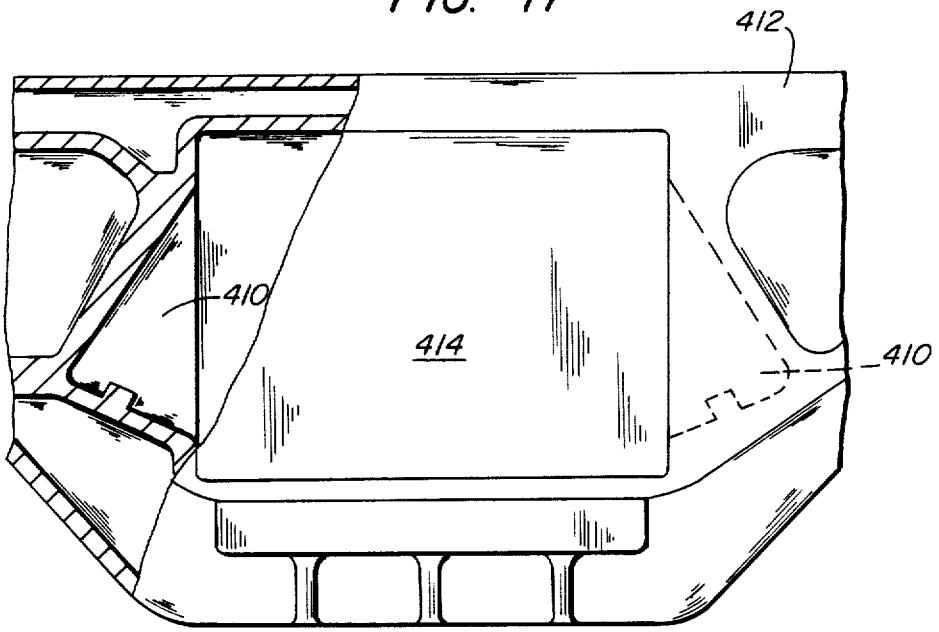
FIG. 17 is a fragmentary, partially sectioned side elevation showing a further embodiment of the invention.

Of course it will be understood that the FIG. 17 embodiment is not intended to represent any specific commercial side frame design. One such truck with side frame pockets to receive friction elements or assemblies is shown in U.S. Pat. No. 3,486,465. It will also be appreciated that such structures as exemplified by FIG. 17 typically are fixed bias arrangements wherein a friction assembly retention spring is supported in a manner that the retention bias exerted thereby against the friction assembly remains substantially constant throughout vertical movement of the bolster with respect to the side frame.

In another known side frame pocket structure, not shown, the sloping innermost pocket surfaces diverge upwardly rather than downwardly from the corresponding friction surfaces.

Figure 18:
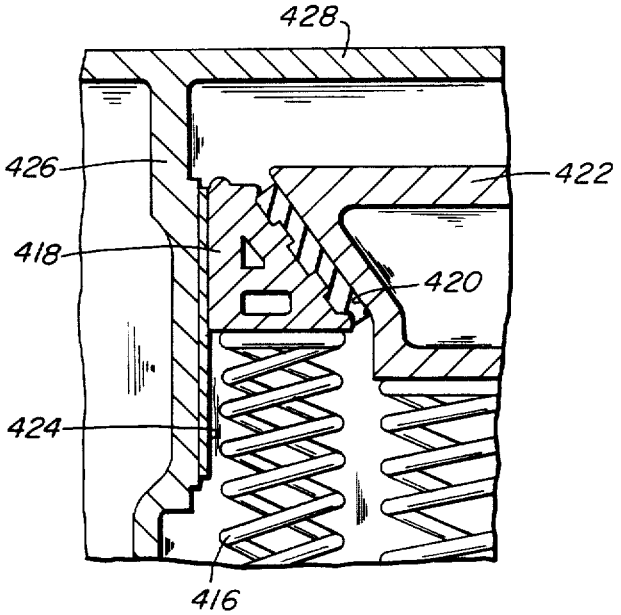
FIG. 18 is a simplified schematic side elevation showing still another embodiment of the invention.

There is shown in FIG. 18 a variable bias alternative to the FIG. 15 and 16 embodiment wherein a retention spring 416 engages a friction assembly 418, which is similar is all salient respects to the friction assembly described with reference to FIGS. 15 and 16, to bias the same into engagement with a sloping pocket surface 420 of a bolster 422, and a wear surface 424 of a column guide portion 426 of a side frame 428. The spring 416 in the FIG. 18 embodiment is supported on the floor or base portion of the side frame window in a manner entirely similar to that described with reference to other embodiments herein and such as shown in FIGS. 13 and 14, for example. The FIG. 18 embodiment thus represents a variable bias alternative wherein compression of spring 416 varies between a minimum and a maximum during vertical movement of bolster 422.

Figure 15:
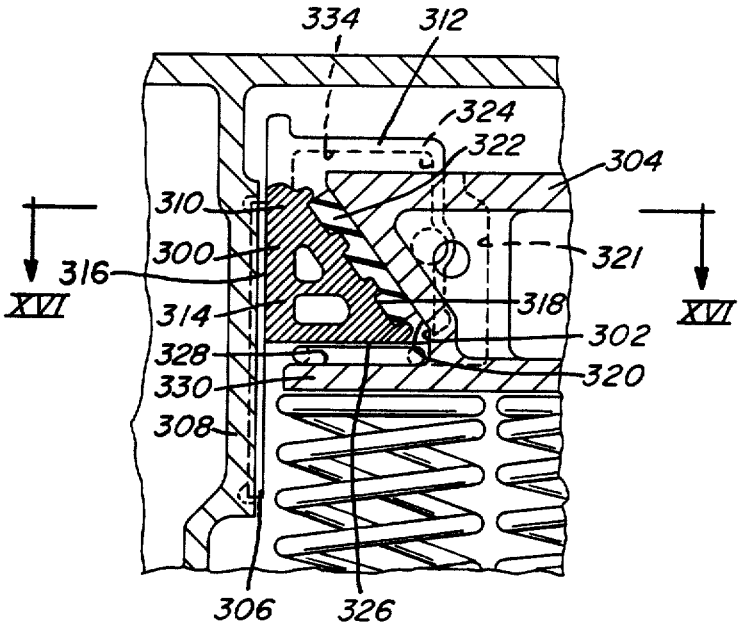
FIG. 15 is a sectional side elevation of a fragmentary portion of a railway truck showing another embodiment of the invention.
Figure 16:
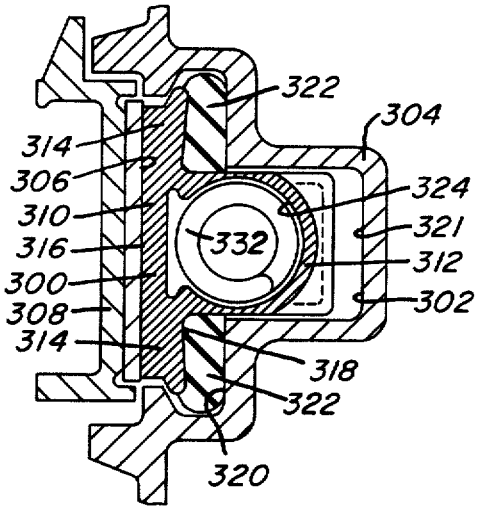
FIG. 16 is a sectioned top plan view taken on line XVI—XVI of FIG. 15.

FIGS. 15 and 16 illustrate yet another embodiment of the invention wherein a friction assembly 300 resides within a pocket 302 of a railway truck bolster 304 adjacent a wear surface 306 of a side frame column guide 308.

The friction assembly 300 comprises a rigid body member 310 having a central upstanding spring retainer portion 312 and a pair of laterally spaced apart, generally wedge shaped wing portions 314. In assembly of the truck an outwardly facing contact surface portion 316 of body 310 is frictionally engageable with wear surface 306, and the inclined face 318 of each wing portion 314 is generally parallel to a corresponding inclined rear wall portion 320 of bolster pocket 302. Intermediate the laterally spaced rear wall portions 320 is an enlarged central pocket portion 321 which receives the spring retainer portion 312, with clearance to permit fit up of the wing portions 314 in pocket 302 as below described. An elastomeric element 322 of design parámeters and with properties of wear, frictional sliding and resilient deformation in keeping with the invention as otherwise described herein, is disposed intermediate and in engagement with surfaces 320 and 318 to provide elastomeric deformational response as above described for control of the frictional sliding between body member 300 and surface 306.

To retain friction assembly 300 within bolster pocket 302 with respect to bolster 304 and side frame column guide 308, an open-ended spring receiving cavity 324 is formed within portion 312 of body member 310. The open end 326 of cavtity 324 faces downwardly and is disposed adjacent an upper surface 328 of a spring seating portion 330 of bolster 304. A retention spring 332 extends within cavity 324 vertically intermediate surface 328 and the upper closed end 334 of cavity 324 and is maintained in compresion therein to continuously exert an upward bias on body member 310. Accordingly, friction assembly 300 is continuously biased upward into engagement with surfaces 320 and 306 to maintain bolster to side frame fit up and to control the frictional energy dissipation which normally occurs in conjunction with relative motion between the bolster 304 and the side frame column guides 308.

The embodiments and variations disclosed hereinabove provide for predictable and controllable modes of response for damping various modes of bolster-to-side frame relative motion by the combined effect of a rigid column guide to friction member frictional engagement and a resilient elastomeric member residing in the bolster pocket in engagement with the innermost sloping wall 120 of the bolster pocket and the adjacent inner surface 112 of rigid element 106.

It will be appreciated that the invention as disclosed pertains to a novel structure and method for maintaining engagement between a railcar truck bolster and the side frames, and for controlling relative motion therebetween by frictional dissipation of kinetic energy. Accordingly, the following description of the mechanics of operation of the invention, as well as any described hereinabove pertaining to operation thereof, is intended to also constitute disclosure of the novel method.

The structure of FIGS. 5 and 6 function in the same manner as was heretofore described with reference to the structures of FIGS. 1 and 2. More specifically, the structure of FIGS. 5 and 6 utilizes the characteristics of an elastomer to maintain a bias on metal surfaces in frictional engagement with each other for an initial time period after the initiation of increased compressive loading and after the initiation of decreased compressive loading. The structure of FIGS. 5 and 6 differs substantially from the elastomer structures previously described in that it is belived it provides an optimum minimum volume in a more advantageous location than the structure of FIG. 1 to 4. The volume of elastomer shown in FIGS. 1 to 4 is quite large compared to the volume of elastomer used in the structure of FIGS. 5 and 6. Since the coat of the appropriate elastomer per unit of volume is much higher than the cost of the cast metal commonly used, the cost of the elastomeric friction assembly of FIGS. 5 and 6 is considerably less than the cost of that are shown in FIGS. 1 to 4. Further, the elastomeric elements 115 are confined within a bolster pocket which provides a good degree of protection against foreign objects (dirt, cinders and the like) becoming trapped between the opposite surfaces of elements 115 and the engaged metal surfaces. Also, by being located in the pocket elements 115 are relatively remote from the heat generating surfaces 126,108 such that the element 115 is not subject to the heat generated by frictional sliding between surfaces 126,108 to any substantial degree. Also, with such location the element 115 is better protected from adverse environmental factors such as oil, snow, and rain.

As discussed hereinabove, the present invention accomplishes the task of accommodating small magnitude relative motion without frictional sliding at the column wear surface, while exerting control over the onset of frictional sliding, thus assuring such frictional sliding will occur in a desired manner to dissipate the energy of larger magnitude relative motions. This is achieved by utilizing the deformational characteristics of the elastomeric element to control and limit the normal force at the metal-to-metal interface, between the column guide wear surface and the friction assembly. Specifically, the elastomeric material will be selected to exhibit a relationship between its shear modulus and its compression modulus which is expressed as follows:

$$E_s > \mu E_c \text{ Tan a}$$

Where a is the included wedge angle of the element 118, $E_c$ is elastomer compression modulus, $E_s$ is elastomer shear modulus, and $\mu$ is the coefficient of friction between the elastomer and the rigid friction element. If $E_s$ is less than $\mu$ $E_c$ Tan a, the elastomer wedge assembly is prone to become self locking, i.e. the friction face forces can increase without bound when there is no sliding at the rigid wedge on bolster interface. For an elastomeric element which satisfies this condition, increasing compression force on the elastomer increases the normal force the column guide wear surface metal-to-metal interface. However, the particular deformational response of the elastomer is effective to impose an upper limit on the magnitude of normal force which can be evolved at the metal-to-metal interface before metal-to-metal frictional sliding occurs.

In FIG. 8 there is shown a simplified representation of the force inputs and resultant elastic deformation of the elastomeric pad 115 for the embodiment of FIG. 5 wherein pad 115 is retained with respect to surface 112 of rigid body or friction shoe 106 only by abutments 118 and without mechanical interlocking such as shown in FIGS. 6 and 7. The solid line representation in FIG. 8, like FIG. 5, depicts the friction assembly 104 in an assembled but non-loaded state with elastomeric pad 115 in a free or non-deformed state. Initially, the downward motion of bolster 100 with the imposition of a retention spring force S upon base 110 of rigid member or friction shoe 106 results in loading friction assembly 104 in compression; that is compressive force C distributed along the friction interface between rigid body 106 and column wear plate 102, and compressive force E distributed along the interface between bolster pocket wall 120 and elastomeric pad 115. Such compressive loading results in an initial deformation of elastomeric pad 115 including shear deformation in the direction $D_1$ parallel to wall 120 and surface 112 and normal compression deformation in the direction $D_2$ perpendicular to wall 120 and surface 112. The deformation of pad 115 under such initial loading could be characterized as being somewhere between the solid line (undeformed) and the dashed line (maximum deformation) depictions of pad 115. Thus, as suggested, the dashed line representation in FIG. 8 should be considered to depict an extreme degree of compression and shear of elastomeric pad 115 as the compression forces E increase and the bolster 110 moves further downward with respect to rigid element 106.

It will be appreciated that these modes of loading and the resultant elastomer deformation as described below are generally to be expected for any of the above described embodiments of the invention, and for relative movement in directions other than vertical, for example, lateral bolster motion with respect to the side frame. The depicted responses under loading of the friction assembly 104 are a combination of rigid surface frictional response and resilient elastomer response. The elastomer response, comprises a multi-step mode of response after the elastomeric body is initially preloaded as previously described. Incremental loading beyond the preload condition results in further deformation of the elastomeric element in normal compression and parallel shear until a threshold of sliding is reached. At the threshold of sliding, the normal force between the elastomeric element and both of surfaces 112 and 120 is a minimum at the toe end of the elastomeric element (i.e. that end toward the direction in which the respective surface 112 or 120 would move if it were to slip with respect to the elastomeric element). The normal force increases along the length of the elastomeric pad from the minimum at the toe end to a maximum at the opposite end (such variation of actual normal forces not being shown in FIG. 8). Thus as the threshold of sliding is passed, frictional sliding occurs between the elastomeric element and at least one of surfaces 112 and 120, and only at the low friction end or toe end (the end having the lower normal force) of the elastomeric element, while the remainder of the frictionally engaged elastomeric surfaces do not slide. This is referred to as partial sliding. With the onset of partial sliding, the elastomeric element also is first subjected to compression in the direction parallel to the surfaces 112 and 120. Further incremental loads sufficiently beyond those required to produce partial sliding ultimately result in bodily sliding of the elastomeric element with respect to surfaces 112 and/or 120, with compression gradients in the elastomer parallel to and all along surfaces 112 and 120.

Further bolster loads beyond the onset of bodily movement of pad 115 result in further bodily sliding of the elastomeric element on at least one of surfaces 112 and 120, with maximum elastomeric relative displacement occurring at A on surface 112 and/or at B on surface 120.

At any state of loading which deforms the elastomeric element beyond that at which sliding occurs at the metal-to-metal frictional engagement between the column wear surface and the friction element whereby energy is dissipated.

In FIG. 8, the sliding motion of elastomeric element 115 with respect to surface 112 is limited by abutments 118 only along the extreme edge. However, this does not materially effect the longitudinal or parallel compression of elastomeric element 115 along the intermediate surfaces of 112 and 120. It is to be noted that such longitudinal or parallel compression is the elastomeric material varies along the surfaces 112 and 120. As the compression increases in magnitude normal to each of the engaged surfaces 112 and 120 as well as parallel to the same surfaces in the direction of impending sliding motion, with a compression gradient as above described, the parallel compression of the deformed element 115 along surface 112 will be greatest adjacent the lower end of element 115 at the edge of abutment 118, and along surface 120 and the parallel compression is then also greatest adjacent the upper end of element 115. Thus, an inherent "bunching up" compression effect parallel to the interface occurs in the elastomeric element 115 adjacent to the leading edge of each potential sliding interface on opposite sides of the elastomer. This is due to higher normal forces adjacent to the leading edge locations (i.e. at the upper end of element 115 where it contacts wall 120 and at the lower end of element 115 where it contacts surface 112). Accordingly, contact between element 115 and/or abutment 118 influences the elastic behavior of element 115 only at or near the contact line with the abutment 118. To the extent that further increments of loading may produce additional longitudinal compression, such additional compression will tend to occur in regions spaced from the defined leading edge, which have undergone a lesser total magnitude of longitudinal compression. Therefore, abutments 118 serve primarily to retain the elastomeric element 115 and prevent substantial migration thereof along surface 112 under repeated loading and relaxation cycles.

The above described potential of at least partial sliding motions of element 115 along either or both of surfaces 120 and 112 serves to further soften or cushion the relative bolster to side frame motion due to the additional shear and compression strain deformations accompanied by the continuous and gradual change in frictional engagment along the two elastomer interfaces. This form of resilient deformation thus derives the maximum elastic benefit from a given volume of elastic material with the bi-directional compression strain and with maximized shear strain.

The above described elastomer behavior during the compression part of a cycle is essentially the same but in reverse order during a spring extension and elastomer relaxation or resiling part of a motion cycle. Thus, during the decreasing bolster load portion of a cycle with partial elastomer relaxation, the elastomer relaxes first partially in normal compression and shear before interface sliding takes place. Any given deformation cycle beginning at a reversal starts with the residual strain bias remaining from the motion just ended.

The sliding of the element 115 at the trailing edge while bunching up at the leading edge adds a friction damping effect along with the internal hysteresis damping from the elastomer modulus bi-axial compression and shear strain deformation ($D_1$ and $D_2$) prior to the rigid friction force breakaway along column guide wear plate 102. Therefore, bolster force inputs can vary, increasing or decreasing with corresponding small bolster-to-side frame motion, without rigid friction breakaway at the column guides and this small motion energy absorption can largely attenuate higher frequency force transmission into the spring mass of the freight car. This effect will tend to reduce the transmitted power levels of rail-wheel interactions. Small motions will absorb only small amounts of energy, but as displacements prior to rigid friction breakaway at the column face 126 increase, more energy is absorbed.

The deformational behavior of element 115 in response to lateral side frame-to-bolster biasing forces is analogous to the behavior in the foregoing description. The lateral column friction breakaway may occur at any level of vertical biasing force; however, lateral break away conditions would be modified depending on the cross sectional configuration and area in the lateral plane of the deforming elastomer and also depending on the elastomer retention mechanism (bonded on one side, frictional sliding, and/or abutting) in the lateral direction.

It will be appreciated that the deformational behavior of the elastomer in each embodiment of the invention is substantially the same for both vertical and lateral force inputs. In FIG. 7 the edges of elastomeric element 115 are shown projecting outwardly of the lateral sides of the rigid element 106, the remainder of elastomeric element 115 having been broken away to illustrate the retention of elastomeric element 115 with respect to rigid member 106. In this and other embodiments of the invention the lateral overhang of the elastomeric element as shown in FIG. 7 provides for a resilient "bumper" which precludes contact between rigid member 106 and the lateral sides of the bolster pocket. Such contact has been a major source of wear in the prior art, notably wear on the interior surfaces of the bolster pockets, and the present invention offers substantial advantages in this regard. The deformational behavior in providing this bumper effect is substantially the same as for relative friction element-to-bolster motion in other planes, as described hereinabove.

It will be further appreciated that the deformational behavior described hereinabove is likewise expected for relative rotational movement of a bolster with respect to a side frame, as for example rotation about a vertical axis passing through the spring group supporting one end of the bolster.

The design process for the friction assembly of this invention must include consideration of the properties of the elastomeric material selected and the geometry of the truck in which it will be used. Elastomer selection must account for the effect of the material stiffness and anticipated changes in its resiliency at elevated temperatures. Elastomer mass and geometry also are to optimized to provide for the desired elastic deformation responses. A related concern regarding truck geometry is that the frictional engagement of the bolster pocket slope on the friction element assembly 18 must be of a sufficient magnitude for the friction generated on the column face to be of sufficient and consistent magnitude and at the same time to preclude excessive self-actuation with downward bolster motion which could result in a self-locking condition. This may occur under conditions which permit the normal forces on the bolster pocket slope and the normal reaction on the column to increase without limit, thus locking the bolster in place. To avoid self-locking conditions, only sufficiently stiff elastomers with critical compression and shear modulus properties, as above described, combined with the proper geometry can be useful to achieve the unique elastomer behavior of this invention. Proper elastomer behavior will provide an elastic effect and, at the same time, generate sufficient up-slope friction on the bolster slope surface, as the bolster moves downward, for a consistent friction generating normal force on the column wear plate; however, a self-locking condition will occur if the shear modulus of the resilient member in FIG. 8 is reduced sufficiently in proportion to the compression modulus so that fully developed friction forces on the bolster pocket slope do not occur. For example, included angles between 30° and 50° bracket the useful angle range for elastomers with moduli between 4,000 and 20,000 PSI in shear, and between 5,000 and 30,000 PSI in compression. These values would include generally the geometry shown in FIGS. 2 and 8. Increases in volume and boundry surface areas, of course, increase the strain energy or modify the elastic behavior for a given geometry. It the elastomeric element in FIG. 8 were to be made twice as thick as shown, the modulus required for critical elastomer behavior might be twice as large.

According to the description hereinabove, the friction assembly of the present invention achieves the advantages of prior elastomeric friction assemblies and cures or substantially alleviates certain limitations of such prior elastomeric friction assemblies. Specifically the inclusion of a rigid primary friction interface on the column guides results in more consistent operation for the friction member. The loading at the primary friction interface will be more consistent and uniform and the rigid primary friction interface will result in but minor deterioration of the response compared to a friction element free to deform and slide elastically at the friction generating surface as well as the other confining surfaces.

The invention herein broadly concerns a side frame-to-bolster friction assembly having resilient elastomeric friction means and a rigid primary friction interface at the side frame. Accordingly, various alternative embodiments and modifications other than those described may be made by those skilled in the art without departing from the broad spirit and scope of the invention. The disclosure hereinabove is intended to be indicative and not definitive of the limits of the invention as the inventor has anticipated and envisioned numerous other such embodiments and modifications which are in keeping with the intended scope of the invention. It is therefore intended that the invention be construed broadly and limited only by the scope of the claims appended hereto.

I claim:

1. In a railway truck assembly having a pair of elongated, laterally spaced metal side frames each having a longitudinally central open area and an elongated metal bolster having the ends thereof extending at least into said open areas, respectively, and supported therein by upwardly extending spring arrangements carried by said side frames with the upper ends thereof in engagement with the undersurfaces of said ends of said bolster, respectively, to support said bolster for movement relative to said side frames, wherein each end of said bolster has opposed downwardly open and open ended pockets with sloping inner surface means converging downwardly with respect to each other and each of said side frames has at the longitudinally spaced ends of said open area thereof essentially vertically extending first surfaces spaced outwardly of the open end of the one of said pockets adjacent thereto, a friction assembly comprising:

a metal friction member adapted to be disposed at least partially within a given one of said pockets adjacent a respective one of said first surfaces with a vertically extending second surface thereof in slidable engagement with said one of said first surfaces, said friction member having a surface extending in spaced confronting relatioship to the said sloping inner surface means of said one of said pockets to provide a pair of spaced confronting surfaces;

an elastomeric means comprised of a pair of laterally spaced elastomeric portions located between said pair of spaced confronting surfaces with each of said portions having a pair of spaced exterior surfaces which are engageable, respectively, with said pair of spaced confronting surfaces;

at least one of said exterior surfaces of said elastomeric means being slidable with respect to the one of said pair of spaced confronting surfaces in engagement therewith;

helical coil spring means engageable with said friction assembly;

means for supporting said helical coil spring means with respect to said friction assembly in a manner to maintain said friction assembly in continuously biased engagement with the respective said first surface and inner surface means;

said elastomeric means having an elastic characteristic that said vertically extending second surface of said friction member is in stationary engagement with the respective said first surface during an initial extent of relative movement of said bolster with respect to said side frames in either one of opposite vertical directions and in sliding engagement with said first surface cooperable therewith after said initial extent, with said initial extent being of relatively constant magnitude throughout repeated cycles of said relative movement in said opposite directions and said continuously biased engagement being maintained at a relatively uniform magnitude of bias during the transition from said stationary engagement to said sliding engagement.

2. The friction assembly as claimed in claim 1 wherein the other of said exterior surfaces of said elastomeric means is mechanically restrained with respect to the respective said spaced confronting surfaces in engagement therewith.

3. The friction assembly as claimed in claim 2 wherein said other exterior surface is mechanically interlocked with said respective spaced confronting surface.

4. The friction assembly as claimed in claim 3 wherein said elastomeric means includes laterally projecting portions and such bolster includes laterally spaced portions which are engageable by said laterally projecting portions to limit the magnitude of lateral movement of said friction assembly with respect thereto.

5. The friction assembly as claimed in claim 2 wherein said other exterior surfaces is confined by abutment means with respect to said respective spaced confronting surface.

6. The friction assembly as claimed in claim 1 wherein said elastomeric means includes laterally projecting portions and such bolster includes laterally spaced portions which are engageable by said laterally projecting portions to limit the magnitude of lateral movement of said friction assembly with respect thereto.

7. The friction assembly as claimed in claim 1 wherein said spaced confronting surfaces are generally parallel surfaces.

8. The friction assembly as claimed in claim 7 wherein said generally parallel surfaces are generally planer parallel surfaces.

9. The friction assembly as claimed in claim 1 wherein said friction means includes a pair of laterally spaced friction members and said vertically extending second surfaces thereof form a respective pair of laterally spaced surfaces which diverge laterally from said pocket with said laterally spaced surfaces engaging respective laterally spaced portions of the respective said first surface.

10. The friction assembly as claimed in claim 9 wherein said elastomeric means includes a pair of elastomeric means engaging the respective said friction members.

11. The friction assembly as claimed in claim 1 wherein each said sloping pocket surface means and each respective said first surface comprise a pair of laterally spaced surface portions which converge laterally outwardly toward the intervening friction means and elastomeric means.

12. The friction assembly as claimed in claim 1 wherein said friction means comprises a body member having laterally spaced wing portions and an intervening retention spring portion, said wing portions having a pair of laterally spaced surfaces which confront respective laterally spaced surface portions of said sloping surface means to receive and retain respective laterally spaced portions of said elastomeric means therebetween.

13. The friction assembly as set forth in claim 12 wherein said pairs of elastomeric portions are cooperable with such pockets, respectively, for lateral restraint of said body members within the respective said pockets.

14. The friction assembly as set forth in claim 13 wherein said body members additionally include abutment means which are cooperable with the respective said elastomeric portions to mechanically restrain said elastomeric portions with respect to said wing portions.

15. The friction assembly as set forth in claim 14 wherein said elastomeric portions include lip portions which overlie a laterally outer extent of each respective one of said wing portions for further mechanical restraint of said elastomeric portions with respect to said wing portions.

16. The friction assembly as claimed in claim 1 wherein said at least one of said exterior surfaces is both of said exterior surfaces of said elastomeric means.

17. The friction assembly as set forth in claim 1 wherein said helical coil spring means is supported by a retention spring support portion of such a bolster.

18. The friction assembly as set forth in claim 1 wherein said helical coil spring means is supported by a retention spring support portion of such a side frame.

19. In a railway truck assembly the combination comprising:

a pair of laterally spaced elongated, upstanding rigid axle supported structures, each having a generally longitudinally central open area;

a rigid car body support structure having portions thereof extending within said open areas;

generally vertically extending spring arrangements carried by said axle supported structures and engaging undersurfaces of said portions of said car body support structure, respectively to support said car body support structure for relative movement with respect to said axle supported structures;

each said portion having pockets which open downwardly and outwardly toward the longitudinal ends of said axle supported structure, said pockets including sloping surfaces which converge toward a point generally longitudinally centrally of said axle supported structure;

said axle supported structures having essentially vertically extending first surface means located outwardly adjacent said open end of a respective one of said pockets and each said vertically extending first surface means comprising a pair of laterally adjacent first surfaces which diverge from the respective said pocket;

metal friction shoe means supported adjacent said laterally adjacent first surfaces, each said friction shoe means including a pair of laterally adjacent vertically extending second surface portions which are maintained in complementary slideable engagement with said laterally adjacent first surfaces, respectively;

each said friction shoe means having a surface extending generally in spaced confronting relationship to said sloping surface of the respective said pocket to provide a respective pair of spaced confronting surfaces;

helical coil spring means engageable in biased engagement with downwardly facing surfaces of said friction shoe means and supported with respect thereto to maintain said friction shoe means in biased engagement within said pockets, respectively;

elastomeric means located between said pairs of spaced confronting surfaces with spaced exterior surfaces thereof engaging said pairs of spaced confronting surfaces, respectively, at least one of said exterior surfaces of each said elastomeric means being slideable with respect to the one of said pair of spaced confronting surfaces in engagement therewith; and each said helical coil spring means exerting a biasing force on the respective said friction shoe means with said biasing force being maintained at a substantially uniform magnitude when the respective said friction shoe means is stationary relative to the respective said laterally adjacent first surfaces.

20. The combination as set forth in claim 19 wherein said shoe means includes a pair of laterally adjacent friction shoes, each said shoe having one of said pair of laterally adjacent surface portions.

21. The combination as set forth in claim 19 wherein said biasing force is maintained at a substantially uniform magnitude with respect to the force of said biased engagement.

22. The combination as set forth in claim 21 wherein said shoe means includes a pair of laterally adjacent friction shoes, each said shoe having one of said pair of laterally adjacent surface portions.

23. In a railway truck assembly having a pair of elongated, laterally spaced metal side frames each having a longitudinally central open area and an elongated metal bolster having the ends thereof extending at least into said open areas, respectively, and supported therein by partially compressed spring arrangements supported by said side frames and having the upper end portions thereof in engagement with the undersurfaces of said ends of said bolster, respectively, to support said bolster for movement relative to said side frames, wherein each end of said bolster has opposed downwardly open and open ended pockets with sloping inner surface means that converge downwardly with respect to each other and each of said side frames has at each of the longitudinally spaced ends of said open area an essentially vertically extending first surface located outwardly adjacent the open end of the respective one of said pockets adjacent thereto and forming a given included angle with the respective sloping inner surface means, a friction assembly comprising:

a metal friction means located in a given one of said pockets and adjacent the respective one of said first surfaces with a vertically extending second surface thereof in slidable engagement with such a first surface, said friction means having laterally spaced surface means extending in spaced confronting relationship to the respective sloping inner surface means of such a pocket to provide respective, laterally spaced pairs of confronting surfaces;

elastomeric means located between said pairs of confronting surfaces with spaced exterior surfaces of said elastomeric means being engageable with the respective said confronting surfaces;

at least one of said exterior surfaces of said elastomeric means being slidable with respect to the one of said confronting surfaces in engagement therewith;

helical coil spring means engageable with said friction means in a manner to bias said friction means into engagement with the respective first surface to maintain a normal force therebetween and to bias said elastomeric means into engagement with the respective sloping inner surface;

said elastomeric means being deformable in a manner to control and limit said normal force to maintain said second surface in stationary engagement with such a first surface during an initial portion of relative movement of said bolster with respect to said side frames.

24. The friction assembly as set forth in claim 23 wherein the ratio of the shear modulus to the compression modulus of said elastomeric means is greater than M Tan a where a is such an included angle and M is the coefficient of friction between said elastomeric means and said metal friction means.

25. A railway truck assembly comprising:

a pair of elongated, laterally spaced upstanding rigid side frames each having an elongated opening with opposed, longitudinally spaced and essentially vertically extending first surfaces;

an elongated rigid bolster having longitudinal end portions thereof located intermediate said vertical first surfaces, respectively;

upwardly extending spring arrangements carried by said side frames with the upper ends thereof in engagement with the undersurfaces of said bolster to support said bolster for movement relative to said side frames;

each said end portion of said bolster having a pair of pocket means which open outwardly toward the respective said vertical first surfaces and downwardly, each said pocket means including sloping inner surfaces which diverge downwardly with respect to said vertical first surfaces, respectively;

friction assemblies received within said pocket means with each said friction assembly comprising a rigid friction member and an elastomeric means;

each said rigid friction member having an essentially vertically extending second surface disposed in slideable engagement with the respective said vertical first surface, and another surface extending generally in spaced essentially parallel and coextensive relationship with the respective said sloping inner surface to provide pairs of spaced confronting surfaces;

said elastomeric means being located between said pairs of spaced confronting surfaces with spaced exterior surfaces thereof in engagement with said pairs of spaced confronting surfaces, respectively;

helical coil spring means engageable in biased engagement with said friction assemblies and supported with respect thereto for biasing said friction assemblies into engagement with said vertical first surfaces and said sloping inner surfaces, respectively;

said elastomeric means being resiliently deformable to permit relative movement between the respective said rigid friction member and said bolster in engagement therewith and to provide the sole direct connection between the respective said rigid friction member and said bolster throughout such relative movement therebetween;

at least one of said exterior surfaces of each said elastomeric means being slideable with respect to the one of said pair of spaced confronting surfaces in engagement therewith; and said elastomeric means being deformable under loading imposed thereon by said bolster and the respective said rigid friction member in a mnner to permit a range of vertical movement of said friction member with respect to said bolster and to maintain said vertically extending second surfaces of said friction member in stationery engagement with said first surfaces, respectively, during relative movement of said bolster with respect to said side frames which includes movement in either of one of opposite vertical directions until such movement in either of said opposite vertical directions is of an extent that at least one of said friction members slides over the one of said first surfaces cooperable therewith, with said extent being relatively constant throughout repeated cycles of said movement in said opposite vertical directions.

26. A railway truck assembly as set forth in claim 25 wherein said range of vertical movement is at least one-half inch

27. A railway truck assembly as set forth in claim 25 wherein said elastomeric means is deformable primarily in shear under such loading.

28. A railway truck assembly as set forth in claim 25 wherein said relative movement further includes relative lateral movement in either one of opposed, generally horizontal directions and said extent for such relative lateral movement is different from the said extent for relative vertical movement.

29. A railway truck assembly as set forth in claim 25 wherein said relative movement further includes relative rotational movement in either one of opposite rotary directions and said extent for such relative rotational movement is different from the said extent for relative vertical movement.

30. A railway truck assembly as set forth in claim 25 wherein both of said spaced exterior surfaces of said elastomeric means are slidable with respect to the one of said pair of spaced confronting surfaces in engagement therewith.

31. A railway truck assembly as set forth in claim 25 wherein the other of said spaced exterior surfaces of siad elastomeric means is restrained from sliding movement with respect to the one of said pair of spaced confronting surfaces in engagement therewith.

32. A railways truck assembly as set forth in claim 25 wherein said sloping inner surfaces and the respective said first surfaces form an included angle in the range of approximately 30° to approximately 50°.

33. A railway truck assembly as set forth in claim 25 wherein said helical coil spring means is supported by said bolster.

34. A railway truck assembly as set forth in claim 25 wherein said helical coil spring means is supported by said side frames.

35. A railway truck assembly as set forth in claim 25 wherein all of said friction means are slideable simultaneously over the respective said vertical first surfaces cooperable therewith.

36. The railway truck assembly as set forth in claim 25 wherein said at least one of said exterior surfaces is both of said exterior surfaces of each of said elastomeric means.

37. The railway truck assembly as set forth in claim 25 wherein said sole direct connection is the sole operative connection between said rigid friction member and said bolster throughout such relative movement therebetween.

38. A railway truck assembly comprising:

a pair of laterally spaced rigid first structures adapted to be supported by railway truck wheels;

an elongated rigid second structure adapted to support a car body and having longitudinal ends thereof located adjacent said first structures, respectively;

spring arrangements extending generally vertically between said first and second structures, respectively, to support said second structure for movement relative to said first structures;

each said longitudinal end having a portion which is cooperable with an adjacent portion of the respective said first structure to form a friction assembly retention means;

in each said retention means, one of said portions including a wear surface and the other of said portions including an open ended pocket which opens toward the respective said wear surface and includes a sloping inner surface which diverges generally vertically from the respective said wear surface;

friction assemblies retained by said retention means with each said friction assembly comprising a rigid friction means and an elastomeric means;

said rigid friction means having respective first surfaces disposed in slideable engagement with said wear surfaces, repectively, and respective second surfaces extending generally in spaced essentially parallel and coextensive relationship with respect to said sloping surfaces, respectively, to provide pairs of spaced confronting surfaces;

said elastomeric means being located between said pairs of spaced confronting surfaces with spaced exterior surfaces thereof engageable with said pairs of spaced confronting surfaces, respectively, to provide the sole direct connection between said rigid friction means and said second structure;

helical coil spring means engageable with each said rigid friction means and supported with respect thereto in a manner to compressively deform said elastomeric means between the respective said pairs of spaced confronting surfaces and to maintain said friction assemblies in biased engagement with the respective said wear surfaces and sloping surfaces;

at least one of said exterior surfaces of each of said elastomeric means being slideable with respect to the one of said pair of spaced confronting surfaces in engagement therewith;

said elastomeric means, when compressively deformed between said respective pairs of spaced confronting surfaces, being further deformable in a manner to permit a range of vertical movement of said rigid friction means with respect to said pocket and to maintain said first surfaces of said rigid friction means in stationary engagement with said wear surfaces, respectively, during an initial extent of relative movement between said first and second structures which includes vertical movement in either one of opposite vertical directions and in sliding engagement on said wear surfaces engaged therewith after said initial extent, with said initial extent being of relatively constant magnitude throughout repeated cycles of said vertical movement in each of said opposite vertical directions.

39. A railway truck assembly as set forth in claim 38 wherein each said pocket is included in said portion of said second structure.

40. The railway truck assembly as set forth in claim 38 wherein each said pocket is included in said portion of said first structure.

41. In a railway truck assembly having a pair of elongated, laterally spaced rigid side frames each having a longitudinally central open area and elongated rigid bolster with longitudinal ends that extend into the open areas, respectively, and are supported therein for movement relative to the side frames by spring arrangements carried by the side frames, and wherein each longitudinal end of the bolster and adjacent portions of the side frames, respectively, provide friction assembly retention means including downwardly open and open ended pockets and essentially vertically extending wear surfaces spaced outwardly of the open ends of the respective pockets to accommodate friction assemblies which are received at least partially within each respective pocket and in engagement with each respective wear surface, the combination comprising:

a rigid friction means adapted to be disposed in a given one of such pockets with a first surface thereof in slideable engagement with the respective one of such wear surfaces and with a second surface thereof extending in spaced confronting relationship to an inner surface means of the pocket to provide a pair of spaced confronting surfaces;

an elastomeric means located between said pair of spaced confronting surfaces with a pair of spaced exterior sufaces of said elastomeric means being engageable with the respective said pair of spaced confronting surfaces;

at least one of said exterior surfaces of said elastomeric means being slideable with respect to the one of said pair of spaced confronting surfaces in engagement therewith;

helical coil spring means supported with respect to said rigid friction means and engageable with a downwardly facing surface thereof to maintain said rigid friction means in biased engagement with such a wear surface and to maintain said elastomeric means in biased engagement with said pair of spaced confronting surfaces; and means for laterally restraining mutually engaged portions of the other of said exterior surfaces of said elastomeric means and the one of said spaced confronting surfaces engaged therewith in a manner to transmit relative lateral shear forces in a given lateral direction between said elastomeric means and said respective one of said spaced confronting surfaces.

42. The combination as set forth in claim 41 wherein said means for laterally restraining is operative within the lateral periphery of said elastomeric means.

43. The combination as set forth in claim 42 wherein said means for lateral restraining is operative solely within the lateral periphery of said elastomeric means.

44. The combination as set forth in claim 42 wherein said means for laterally restraining includes mechanically interfering means having respective, mutually engaged surface portions which support such relative lateral shear.

45. The combination as set forth in claim 44 wherein said other of said exterior surfaces and the respective one of said spaced confronting surfaces in engagement therewith include intermeshing projections and depressions disposed within the lateral periphery of said other of said exterior surfaces.

46. The combination as set forth in claim 41 wherein said elastomeric means further includes laterally projecting portions which are engageable with respective laterally spaced portions of such a pocket to limit the magnitude of lateral movement of said elastomeric means with respect thereto.

47. The combination as set forth in claim 46 wherein said laterally projecting portions overlie respective laterally outer portions of said friction means intermediate said friction means and laterally adjacent side wall portions of such a pocket.

48. A railway truck assembly comprising:

a pair of elongated, laterally spaced upstanding rigid side frames each having an elongated opening with opposed longitudinally spaced and essentially vertically extending first surfaces;

an elongated rigid bolster having longitudinal end portions thereof located intermediate said vertical first surfaces, respectively;

upwardly extending spring arrangements carried by said side frames with the upper ends thereof in engagement with undersurfaces of said bolster to support said bolster for movement relative to said side frames;

each said end portion of said bolster having pocket means which open outwardly toward the respective said vertical first surfaces and downwardly and each said pocket means including a sloping inner surface which diverges downwardly with respect to the respective said vertical first surface;

friction assemblies received within said pocket means with each said friction assembly comprising a rigid friction member and an elastomeric means;

each said rigid friction member having an essentially vertically extending second surface disposed in slideable engagement with the respective said vertical first surface, and another surface extending generally in spaced essentially parallel and coextensive ralationship with the respective said sloping inner surface; to provide pairs of spaced confronting surfaces;

said elastomeric means being located between said pairs of spaced confronting surfaces and having spaced exterior surfaces thereof in engagement with said pairs of spaced confronting surfaces, respectively;

helical coil spring means engageable in biased engagement with said friction assemblies and supported with respect thereto for biasing said friction assemblies into engagement with said vertical first surfaces and said sloping inner surfaces, respectively;

said elastomeric means being resiliently deformable to accommodate relative movement between the respective said rigid friction member and said bolster and to provide the sole direct connection between said rigid friction member and said bolster throughout such relative movement therebetween;

said elastomeric means providing at least one of a pair of mutually engaged, relatively slideable surfaces to further accommodate such relative movement between the respective said rigid friction member and bolster;

said elastomeric means being deformable under loading imposed thereon by said bolster and the respective said rigid friction member in a manner to permit a range of vertical movement of said friction member with respect to said bolster and to maintain said vertically extending second surfaces of said friction member in stationary engagement with said first surfaces, respectively, during relative movement of said bolster with respect to said side frames which includes movement in either one of opposite vertical directions until such movement in either one of said opposite vertical directions is of an extent that at least one of said friction members slides over the one of said first surfaces cooperable therewith, with said extent being relatively constant throughout repeated cycles of said movement in said opposite vertical directions.

49. The railway truck assembly as set forth in claim 48 wherein said sole direct connection is the sole operative connection between said rigid friction member and said bolster throughout such relative movement therebetween.

* * * * *